US010696476B2

(12) United States Patent
Morand

(10) Patent No.: US 10,696,476 B2
(45) Date of Patent: Jun. 30, 2020

(54) CASSETTE AND APPARATUS FOR USE IN DISPOSING WASTE MATERIALS INTO AN ELONGATED FLEXIBLE TUBE

(71) Applicant: International Refills Company LTD., Christ Church (BB)

(72) Inventor: Michel Morand, Verdun (CA)

(73) Assignee: INTERNATIONAL REFILLS COMPANY LTD., Christ Church (BB)

( * ) Notice: Subject to any disclaimer, the term of this patent is extended or adjusted under 35 U.S.C. 154(b) by 0 days.

(21) Appl. No.: 15/736,895

(22) PCT Filed: Jun. 14, 2016

(86) PCT No.: PCT/IB2016/053505
§ 371 (c)(1),
(2) Date: Dec. 15, 2017

(87) PCT Pub. No.: WO2016/203370
PCT Pub. Date: Dec. 22, 2016

(65) Prior Publication Data

US 2018/0362250 A1 Dec. 20, 2018

Related U.S. Application Data

(60) Provisional application No. 62/175,970, filed on Jun. 15, 2015.

(51) Int. Cl.
*B65F 1/00* (2006.01)
*B65F 1/06* (2006.01)

(52) U.S. Cl.
CPC ..... *B65F 1/0006* (2013.01); *B65F 1/06* (2013.01); *B65F 1/062* (2013.01); *B65F 2230/148* (2013.01)

(58) Field of Classification Search
CPC ..... B65F 1/00–0006; B65F 2230/00–148
See application file for complete search history.

(56) References Cited

U.S. PATENT DOCUMENTS 3,452,368 A 7/1969 Couper
3,534,866 A 10/1970 Asenbauer
(Continued)

FOREIGN PATENT DOCUMENTS

CA 1298191 3/1992
CA 2197177 2/1996
(Continued)

OTHER PUBLICATIONS

Decision Denying Institution of Inter Partes Review, 37 C.F.R. § 42.108(a), Case IPR2016-01154, U.S. Pat. No. 8,899,420 B2, USPTO Patent Trial and Appeal Board, Dec. 12, 2016.
(Continued)

*Primary Examiner* — Kareen K Thomas
(74) *Attorney, Agent, or Firm* — Cantor Colburn LLP

(57) ABSTRACT

A cassette for packing waste material into an elongated tube of flexible material is provided. The cassette includes a ring-shaped receptacle defining a central opening and a storage area for receiving the elongated tube of flexible material. The cassette also includes a cover at a top portion of the storage area and a plurality of projecting elements extending from a periphery of the cassette and being configured to support the cassette in a waste storage container. Also provided is a cassette which includes a lip having a variable projection width. A waste storage container is also provided including a cassette holder having a hollow area for removably receiving a cassette, the cassette being configured to matingly fit into the hollow area.

24 Claims, 19 Drawing Sheets

(56) References Cited

U.S. PATENT DOCUMENTS

| | | | | |
|---|---|---|---|---|
| 3,536,192 | A * | 10/1970 | Couper | A47K 17/003 206/303 |
| 3,547,309 | A | 12/1970 | Pusey | |
| 3,613,943 | A | 10/1971 | Bridenstine | |
| 3,638,827 | A | 2/1972 | Lau | |
| 3,746,159 | A | 7/1973 | May | |
| 3,853,223 | A | 12/1974 | Nowlain | |
| 3,888,406 | A | 6/1975 | Nippes | |
| 4,693,372 | A | 9/1987 | O'Neill | |
| 4,869,049 | A | 9/1989 | Richards | |
| 4,917,263 | A | 4/1990 | Korb | |
| 4,934,529 | A | 6/1990 | Richards et al. | |
| D322,030 | S | 12/1991 | Chumenti | |
| 5,117,778 | A | 6/1992 | Imamura | |
| 5,337,581 | A | 8/1994 | Lott | |
| 5,590,512 | A | 1/1997 | Richards | |
| 5,632,401 | A | 5/1997 | Hurd | |
| D381,472 | S | 7/1997 | Catalano et al. | |
| 5,699,925 | A | 12/1997 | Petruzzi | |
| 5,947,295 | A | 9/1999 | Lutin | |
| 6,116,780 | A | 9/2000 | Young | |
| 6,128,890 | A * | 10/2000 | Firth | B65F 1/062 53/567 |
| 6,170,240 | B1 | 1/2001 | Jacoby | |
| 6,516,588 | B2 | 2/2003 | Jensen | |
| 6,612,099 | B2 | 9/2003 | Stravitz | |
| 6,672,472 | B1 | 1/2004 | Rockwood | |
| 6,719,194 | B2 | 4/2004 | Richards | |
| 6,925,781 | B1 | 8/2005 | Knuth | |
| 6,931,684 | B1 | 8/2005 | Henegar | |
| 6,941,733 | B2 | 9/2005 | Chomik | |
| 6,974,029 | B2 | 12/2005 | Morand | |
| 6,993,891 | B2 | 2/2006 | Richardson | |
| 7,073,311 | B2 | 7/2006 | Chomik et al. | |
| 7,080,418 | B2 | 7/2006 | Henegar | |
| 7,086,569 | B2 | 8/2006 | Stravitz | |
| 7,100,767 | B2 | 9/2006 | Chomik et al. | |
| 7,114,314 | B2 | 10/2006 | Stravitz | |
| 7,350,663 | B2 | 4/2008 | Chomik et al. | |
| 7,406,814 | B2 | 8/2008 | Morand | |
| 7,434,377 | B2 | 10/2008 | Stravitz | |
| 7,490,731 | B2 | 2/2009 | Hautop | |
| 7,500,339 | B2 | 3/2009 | Knuth | |
| 7,616,659 | B2 | 11/2009 | Benedyk | |
| 7,841,853 | B2 | 11/2010 | Yu | |
| 7,931,150 | B2 | 4/2011 | Morand | |
| 7,958,704 | B2 * | 6/2011 | Stravitz | B65B 9/15 206/303 |
| 8,484,936 | B2 | 7/2013 | Tannock | |
| 8,899,420 | B2 | 12/2014 | Morand | |
| 2002/0078665 | A1 | 6/2002 | Salman | |
| 2002/0130060 | A1 | 9/2002 | Carson et al. | |
| 2002/0162304 | A1 | 11/2002 | Stravitz | |
| 2003/0121923 | A1 | 7/2003 | Morand et al. | |
| 2003/0213804 | A1 | 11/2003 | Chomik et al. | |
| 2003/0218022 | A1 | 11/2003 | Chomik | |
| 2004/0020175 | A1 | 2/2004 | Stravitz | |
| 2004/0134914 | A1 | 7/2004 | Richards | |
| 2004/0246304 | A1 | 12/2004 | Takahashi et al. | |
| 2005/0016890 | A1 | 1/2005 | Tannock | |
| 2005/0028491 | A1 | 2/2005 | Stravitz | |
| 2005/0044819 | A1 | 3/2005 | Chomik et al. | |
| 2005/0103499 | A1 | 5/2005 | Chomik et al. | |
| 2005/0115207 | A1 | 6/2005 | Chomik | |
| 2005/0150804 | A1 | 7/2005 | Chen | |
| 2005/0183400 | A1 | 8/2005 | Stravitz | |
| 2005/0183401 | A1 | 8/2005 | Stravitz | |
| 2005/0193691 | A1 | 9/2005 | Stravitz | |
| 2005/0217214 | A1 | 10/2005 | Richardson | |
| 2005/0274093 | A1 | 12/2005 | Stravitz | |
| 2006/0021301 | A1 | 2/2006 | Stravitz | |
| 2006/0130439 | A1 | 6/2006 | Stravitz | |
| 2006/0237461 | A1 | 10/2006 | Chomik et al. | |
| 2006/0248862 | A1 | 11/2006 | Morand | |
| 2006/0249418 | A1 | 11/2006 | Chomik | |
| 2006/0266751 | A1 | 11/2006 | Ali et al. | |
| 2007/0080092 | A1 | 4/2007 | Deluca et al. | |
| 2007/0175182 | A1 | 8/2007 | Stravitz | |
| 2007/0180798 | A1 | 8/2007 | Stravitz | |
| 2007/0246465 | A1 | 10/2007 | Stravitz et al. | |
| 2008/0121640 | A1 | 5/2008 | Chomik | |
| 2008/0272140 | A1 * | 11/2008 | Mowers | B65F 1/062 221/69 |
| 2011/0100995 | A1 * | 5/2011 | Dunn | B32B 27/08 220/495.01 |
| 2012/0091295 | A1 * | 4/2012 | Morand | B65F 1/062 248/99 |
| 2014/0110293 | A1 * | 4/2014 | Dunn | B65F 1/062 206/389 |

FOREIGN PATENT DOCUMENTS

| | | | |
|---|---|---|---|
| CA | 2838799 | A1 | 10/2003 |
| CA | 2441837 | A1 | 5/2004 |
| CA | 2726926 | A1 | 3/2011 |
| CA | 2640384 | A1 | 12/2017 |
| DE | 816342 | C | 10/1951 |
| DE | 2239880 | | 2/1974 |
| DE | 9319683 | | 6/2006 |
| DE | 202005020171 | | 7/2006 |
| DE | 202005015081 | U | 2/2007 |
| DE | 202005015081 | | 3/2007 |
| DE | 202005015117 | | 3/2007 |
| DM | 0007920310001 | | 9/2007 |
| EP | 0005660 | | 11/1979 |
| EP | 0303517 | A1 | 2/1989 |
| EP | 0353922 | | 2/1990 |
| EP | 0356051 | | 2/1990 |
| EP | 1283170 | | 2/2003 |
| EP | 1343694 | | 8/2005 |
| EP | 2019042 | | 1/2009 |
| EP | 2091847 | | 3/2011 |
| EP | 1680340 | | 11/2011 |
| EP | 2167404 | | 2/2013 |
| GB | 2206094 | | 12/1988 |
| GB | 2409866 | | 7/2015 |
| JP | 05146700 | | 6/1993 |
| JP | 05286503 | | 11/1993 |
| JP | 06183505 | | 7/1994 |
| JP | 8224883 | A | 9/1996 |
| JP | 2000247401 | | 9/2000 |
| JP | 3256847 | | 2/2002 |
| JP | 2003241353 | A | 8/2003 |
| JP | 2004175508 | | 6/2004 |
| WO | 1999020547 | | 4/1999 |
| WO | 02100723 | A1 | 12/2002 |
| WO | 2002100723 | | 12/2002 |
| WO | 2006029038 | A2 | 3/2006 |
| WO | 2007071054 | | 6/2007 |
| WO | 2009141583 | A1 | 11/2009 |

OTHER PUBLICATIONS

Decision Denying Institution of Inter Partes Review, 37 C.F.R. § 42.108(a) , Case IPR2017-00050, U.S. Pat. No. 8,899,420 B2, USPTO Patent Trial and Appeal Board, Apr. 3, 2017.

Declaration of A. Justin Poplin, Oct. 7, 2016.

Declaration of Jeffrey Swan, May 17, 2016.

Definition of "continuous" from Merriam-Webster's Online Dictionary, available at http://www.merriamwebster.com/dictionary/continuous, accessed on May 16, 2016.

Design Project Online Resource Mechanics of Materials, accessible at http://www.esm.psu.edu/courses/emch13d/design/designtech/ manufacturing/manuf 12.html, as archived on Mar. 20, 2005 on https://archive.org/web/, accessed Aug. 14, 2016.

Dominick V. Rosato et al., Injection Molding Handbook (3rd ed. 2000).

Douglas M. Bryce, Plastic Injection Molding, manufacturing process fundamentals (vol. 1, Apr. 30, 1996).

Geoffrey Boothroyd et al., Product Design,for Manufacture and Assembly (1994).

(56) References Cited

OTHER PUBLICATIONS

Injection Moulding, accessible at http://people.bath.ac.uk/en3hl/inject.html, as archived on Dec. 3, 2007 on https://archive.org/web/, accessed Aug. 14, 2016.
ISBN information for Boothroyd (Ex. 1120-3) at www.lookupbylSBN.com, accessed on Aug. 17, 2016.
ISBN information for Bryce (Ex. 1122-2) at www.lookupbyISBN.com, accessed on Aug. 17, 2016.
ISBN information for Rosato (Ex. 1121-2) at www.lookupbyISBN.com, accessed on Aug. 17, 2016.
PCT International Preliminary Report on Patentability; International Application No. PCT/US2008/062367; International Filing Date May 2, 2008; dated Nov. 10, 2009.
Petition and Exhibit List from Inter Partes Review No. 2016-01154 re U.S. Pat. No. 8,899,420.
Petition and Exhibit List from Inter Partes Review No. 2017-00050 re U.S. Pat. No. 8,899,420.
Request for Cancellation re DE 202007019629 dated Jul. 15, 2015, and English translation thereof.
Response to Request for Cancellation re DE 202007019629 dated Feb. 4, 2016, and English translation thereof.
USPTO, Prior Art Under the AIA, First Inventor to File Comprehensive Training, available at http://www.uspto.gov/sites/default/files/aia_implementation/fitf_comprehensive_training_prior_art_under_aia.pdf, accessed on May 16, 2016.
Written Opinion of the Inaternational Searching Authority for corresponding application PCT/IB2016/053505 filed Jun. 14, 2016; dated Dec. 20, 2016.
International Search Report for corresponding application PCT/IB2016/053505 filed Jun. 14, 2016; dated Dec. 20, 2016.
Written Opinion of the International Searching Authority for corresponding application PCT/IB2016/053505 filed Jun. 14, 2016; dated Dec. 20, 2016.

* cited by examiner

CASSETTE AND APPARATUS FOR USE IN DISPOSING WASTE MATERIALS INTO AN ELONGATED FLEXIBLE TUBE

FIELD OF THE INVENTION

The invention generally relates to the disposing of waste materials into a waste storage container and in particular relates to a cassette and a waste storage container for use in disposing waste materials.

BACKGROUND

Apparatuses for packaging and disposing of waste materials into a waste storage container are known in the art. For example, Canadian Patent No. 2,640,384, the contents of which are incorporated by reference, describes a cassette and apparatus for packing disposable objects into a bag formed from an elongated tube of flexible material. Generally speaking, prior art systems provide a cassette including an accumulated elongated flexible tube of plastic material, where the cassette is installed in a top portion of a waste storage container. The loading of the cassette into the container generally requires the user to insert the cassette into a cassette holding area of the container, to pull from the cassette a portion of flexible tubing, to form a knot in the end of the flexible tubing and to pass the knotted end of the flexible tubing into an enclosure of the container in which waste material is stored.

Generally speaking, a problem with existing prior art systems is that some users find that the cassettes can be difficult to install and that existing mechanisms for retaining the cassette in the container are somewhat limited.

As such, there is a need in the art to provide a cassette and corresponding container in which the cassette can easily be loaded by the user and that will be securely held in the waste storage container during use.

SUMMARY

According to a first aspect, the invention provides a cassette for packing waste material into an elongated tube of flexible material, the cassette, comprising a ring-shaped receptacle defining a central opening, the central opening extending along a generally vertical axis, the ring-shaped receptacle defining a storage area receiving a length of elongated tube of flexible material in a folded condition outward of the central opening. The cassette further includes a plurality of projecting elements in a spaced apart relationship, the projecting elements extending from a periphery of the cassette and being configured to support the cassette in a waste storage container.

For the purpose of this specification ring-shape means a closed figure. Specific examples include an annular shape, an oval shape, a rectangular or square shape, hexagonal, octagonal, and/or any other polygonal closed figure shape.

In a specific and non-limiting example of implementation, the plurality of projecting elements lie in a common imaginary plane, which is preferably horizontal. Each projecting element has an extent in a peripheral direction of the cassette that is significantly larger than a thickness of the projecting element measured along the vertical axis.

Advantageously, the projecting elements are equally spaced around the periphery of the cassette.

In a specific embodiment, at least one projecting element includes a male or female interlocking component configured to engage a complementary male or female interlocking component in the waste storage container.

According to a second aspect, the invention provides a cassette for packing waste material into an elongated tube of flexible material, the cassette, comprising a ring-shaped receptacle defining a central opening, the central opening extending along a generally vertical axis, the ring-shaped receptacle defining a storage area receiving the elongated tube of flexible material in a collapsed condition outward of the central opening. The cassette further comprises a lip projecting outwardly from the cassette and extending along at least a portion of the periphery of the cassette, the lip having a variable projection width.

In a specific example, the receptacle includes a first pair of generally parallel sides and a second pair of generally parallel sides, which extend generally transversally to the first pair of parallel sides. The first and second pairs of sides are major sides, the cassette including a first pair of generally parallel minor sides and a second pair of generally parallel minor sides, the minor sides being shorter than the major sides. The projection width of the lip is larger in the vicinity of the minor sides than the projection width in the vicinity of the major sides.

In a third broad aspect the invention provides a cassette for packing waste material into an elongated tube of flexible material, for use in a waste storage container, the storage container including a cassette holder, the cassette holder having a rim defining a hollow area for removably receiving the cassette, the hollow area having an outer peripheral wall portion having a generally octagonal configuration, the wall portion including a first pair of opposed cassette support elements and a second pair of opposed cassette support elements, the cassette having a body configured to matingly fit the hollow area and having means to engage the rim to suspend the cassette from the rim.

In a specific example of implementation, the cassette including a plurality spaced apart projecting elements configured for engaging the first and second pairs of opposed cassette support elements. The cassette has a generally octagonal configuration including minor sides and major sides, the minor sides being shorter than the major sides, the projecting elements being associated with minor sides of the cassette. The plurality of spaced apart projecting elements lie in a common imaginary plane.

In a fourth broad aspect, the invention further provides a cassette for packing waste material into an elongated tube of flexible material, for use in a waste storage container, the storage container including a cassette holder, the cassette holder having a component moveable between an opened position and a closed position, the component including a top face and a bottom face generally opposite the top face, the component including an aperture and an elongated projection that extends from the bottom face, the elongated projection extending at partially around the aperture, the elongated projection including a first and second generally opposite and parallel sides, a third side generally transverse to the first and second sides, a fourth side extending obliquely between the first side and the third side and fifth side extending obliquely between the second side and the third side, cassette comprising:

(a) a ring-shaped receptacle defining a central opening, the central opening extending along a generally vertical axis, the ring-shaped receptacle defining a storage area receiving a length of elongated tube of flexible material in a folded condition outward of the central opening;

(b) a continuous gap extending along a periphery of the ring-shaped receptacle to receive the elongated projection when the component is in the closed position, the continuous gap having first, second, third, fourth and fifth segments, configured to mate with the first, second, third, fourth and fifth sides, respectively.

In a specific example of implementation of the cassette the gap is configured to dispense the elongated tube of flexible material from the storage area.

In a fifth broad aspect, the invention further provides a waste storage container including:

(a) a holder for a cassette for packing waste material into an elongated tube of flexible material, the cassette, comprising:

(a) a ring-shaped receptacle defining a central opening, the central opening extending along a generally vertical axis, the ring-shaped receptacle defining a storage area receiving a length of elongated tube of flexible material in a folded condition outward of the central opening;

(b) a plurality of projecting elements in a spaced apart relationship, the projecting elements extending from a periphery of the cassette and being configured to support the cassette in a waste storage container.

(b) the waste storage container including a cassette holder including a plurality of projecting supports configured to engage the projecting elements to retain the cassette in the cassette holder.

In a specific example of implementation of the waste storage container, the plurality of projecting supports include a first pair of generally opposed projecting supports and a second pair of generally opposed projecting supports. The cassette holder defines a generally octagonal recessed area to matingly receive the cassette.

In a sixth broad aspect, the invention provides a waste storage container for use with a cassette for packing waste material into an elongated tube of flexible material, the waste storage container including:

(a) a cassette holder, the cassette holder having a component moveable between an opened position and a closed position, the component including a top face and a bottom face generally opposite the top face, the component including an aperture and an elongated projection that extends from the bottom face, the elongated projection extending at partially around the aperture, the elongated projection including a first and second generally opposite and parallel sides, a third side generally transverse to the first and second sides, a fourth side extending obliquely between the first side and the third side and fifth side extending obliquely between the second side and the third side, the projection configured to enter a gap formed in the cassette through which elongated tube is dispensed.

In a seventh broad aspect, the invention provides a refill for a cassette for packing waste material into an elongated tube of flexible material, the cassette comprising a ring-shaped receptacle defining a central opening, the central opening extending along a generally vertical axis, the ring-shaped receptacle defining a storage area receiving a length of elongated tube of flexible material in a folded condition outward of the central opening, the refill including:

(a) a cover configured to be mounted to the receptacle, the cover having an opening that registers with the central opening when the cover is mounted to the receptacle;

(b) a length of elongated flexible tube in a collapsed condition configured to enter the storage area when the cover is mounted on the receptacle;

(c) means for retaining the elongated tube in a collapsed condition to the cover.

In a specific example of implementation, the means for retaining are releasable to allow the elongated flexible tube to be dispensed from the receptacle when the cover is mounted to the receptacle. Examples of means for releasing include a tear-away wrapper and/or a plurality of bands encircling the cover and the flexible tube in a collapsed condition.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which:

FIG. 4A is a top elevational view of a closure assembly of the waste storage container, that includes the cassette holder, showing the lid of the closure assembly in the open position in which the waste storage container is ready to receive waste material to be disposed of;

Figure 1A:
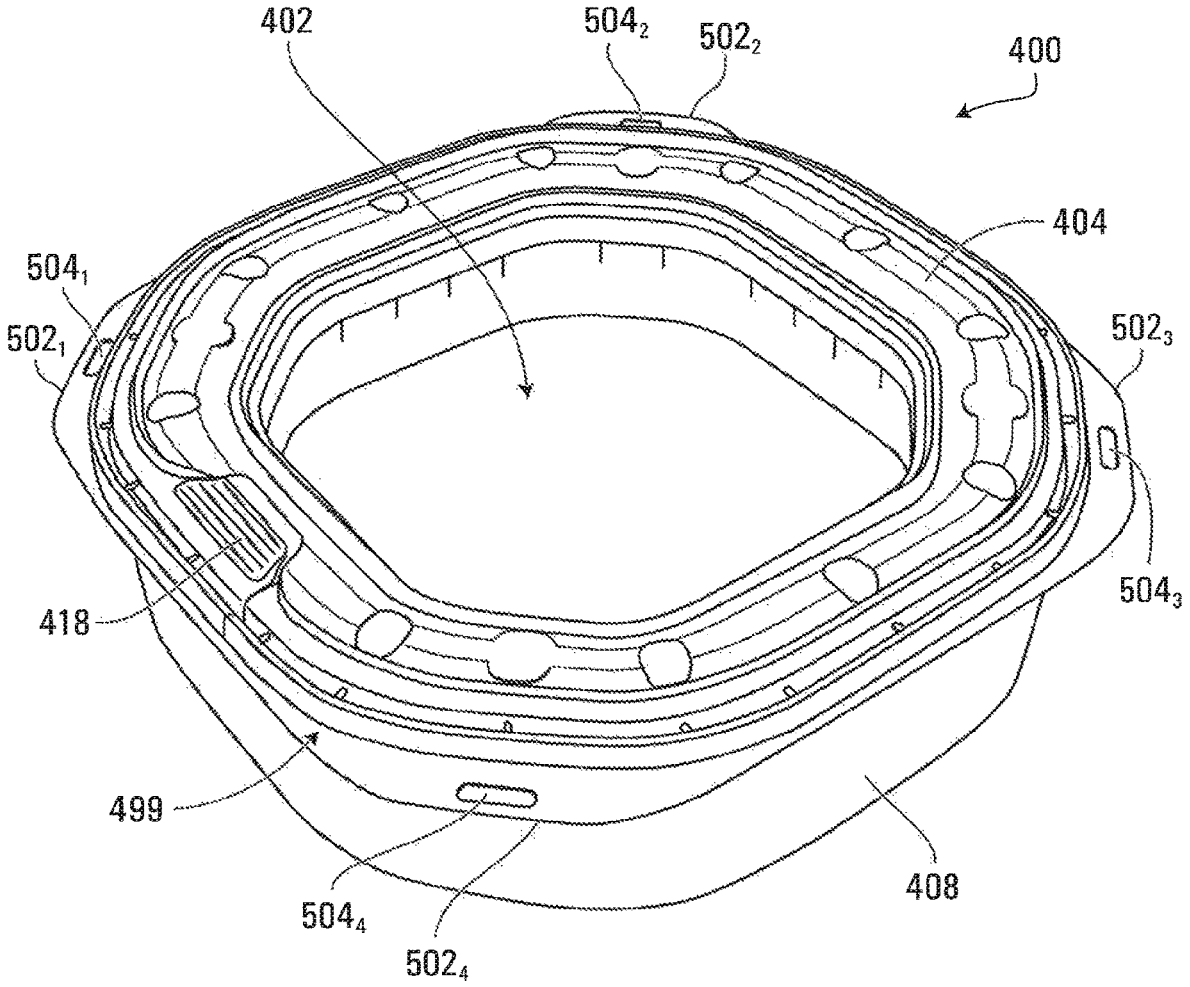
FIG. 1A illustrates a perspective view from the top of a cassette in accordance with an embodiment of the invention. The cassette has an octagonal configuration but other ring-shaped geometries are possible.
Figure 1B:
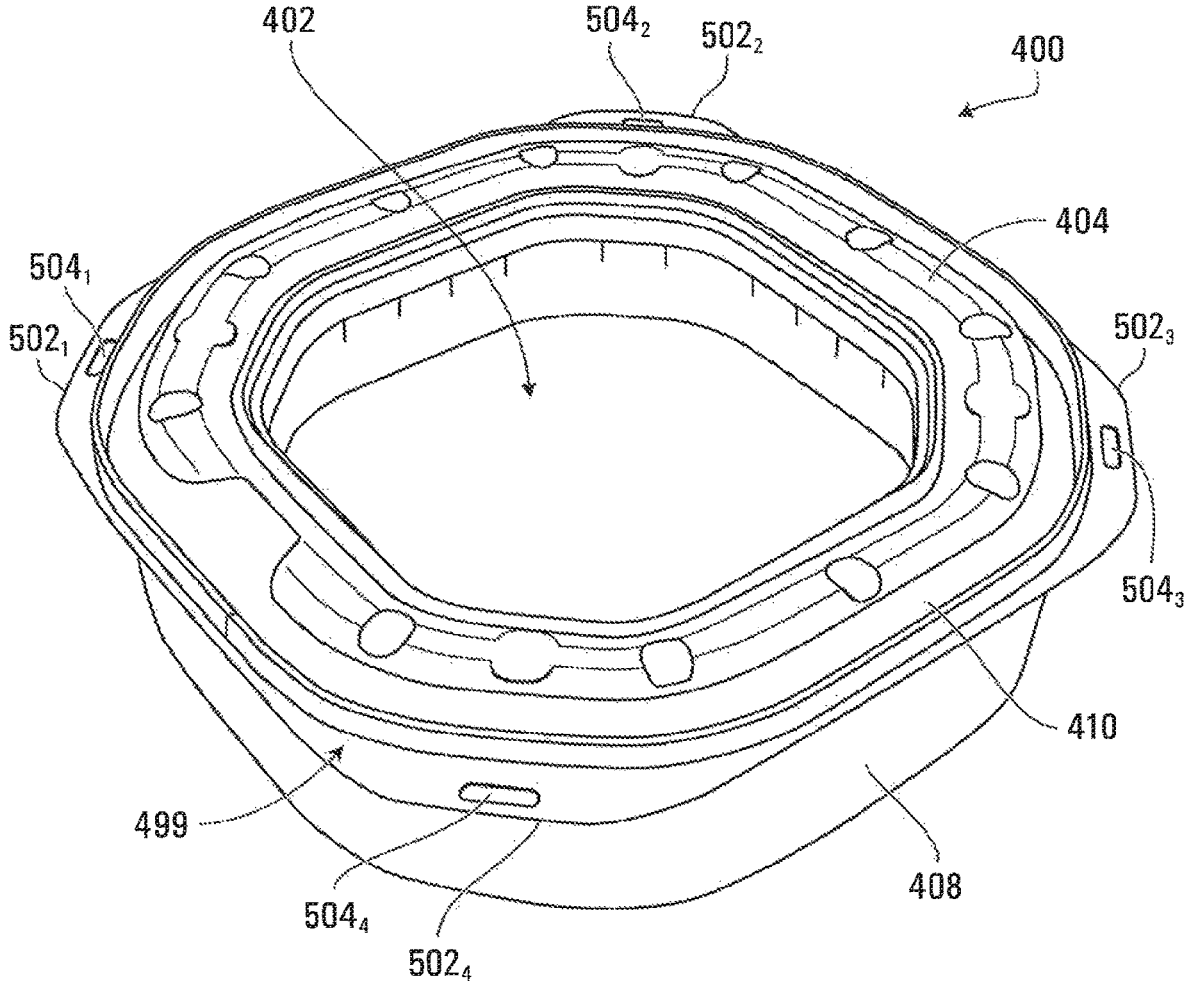
FIG. 1B illustrates a top perspective view of the cassette in FIG. 1A with a protective tear-band removed.
Figure 1C:
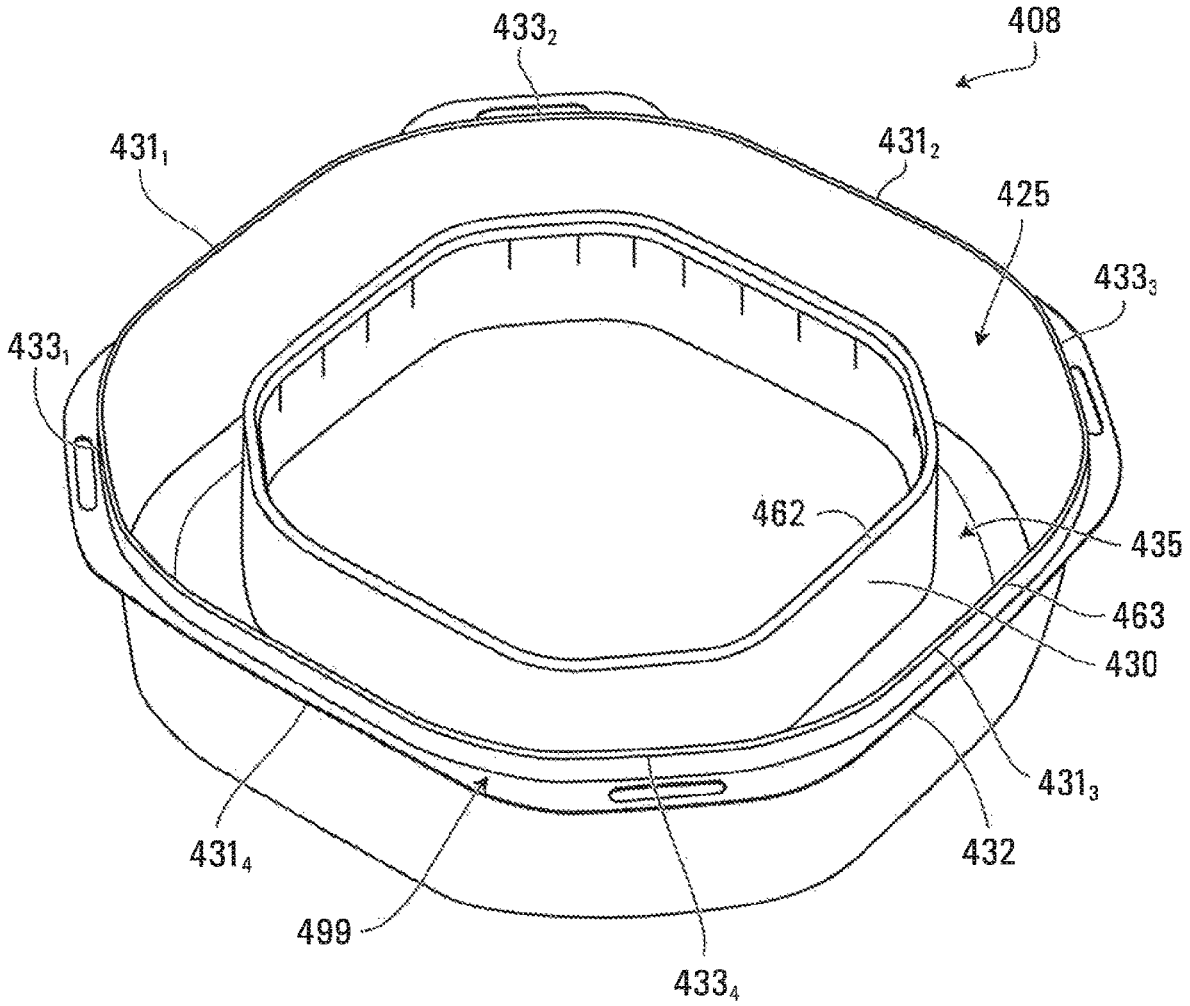
FIG. 1C is a top perspective view of the receptacle of the cassette of FIG. 1A.

It is to be expressly understood that the description and drawings are only for the purpose of illustrating certain embodiments of the invention and are an aid for understanding. They are not intended to be a definition of the limits of the invention.

DETAILED DESCRIPTION

FIGS. 1A to 1G illustrate a cassette 400 and various elements of the cassette 400 in accordance with an embodiment of the invention. The cassette 400 includes a receptacle 408. The receptacle 408 defines a storage area 425 for holding an elongated tube of flexible material (not illustrated). The tube is collapsed (e.g., folded) to fit into the storage area 425. The tube would typically be round in cross-section but that is not essential. The tube could have other shapes as well, such as oval, rectangular, etc.

The receptacle 408 is ring-shaped. For the purpose of this specification ring-shape means a closed figure. Specific examples include an annular shape, an oval shape, a rectangular or square shape, hexagonal, octagonal, and/or any other polygonal closed figure shape. The receptacle 408 has an inner wall 430 defining a central, generally vertically extending opening 402. The opening is octagonal having four major sides (longer sides) and four minor sides (shorter sides). The receptacle 408 also includes an outer wall 432 that is laterally outwardly spaced apart from the inner wall 430. The outer wall 432 is also octagonal and has major sides and minor sides.

A bottom portion 435 of the receptacle 408 connects the inner wall 430 and outer wall 432. In other words, the ring-shaped receptacle 408 defines the central opening 402, which extends along a generally vertical axis and also defines the storage area 425 for receiving the elongated tube of flexible material in a collapsed (e.g., folded) condition outward of the central opening 402.

Figure 1D:
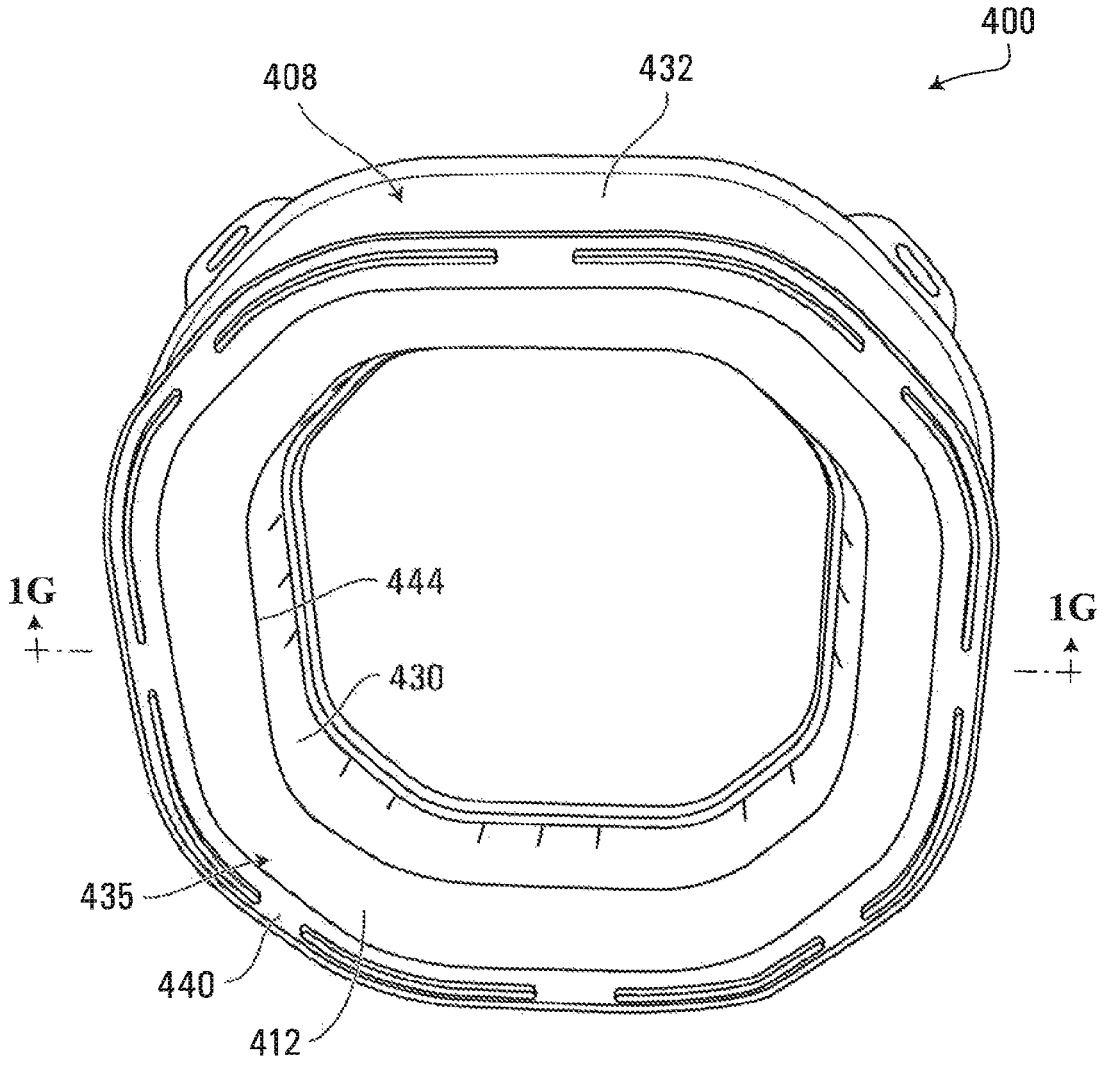
FIG. 1D illustrates a bottom perspective view of the receptacle of FIG. 1C.
Figure 1E:
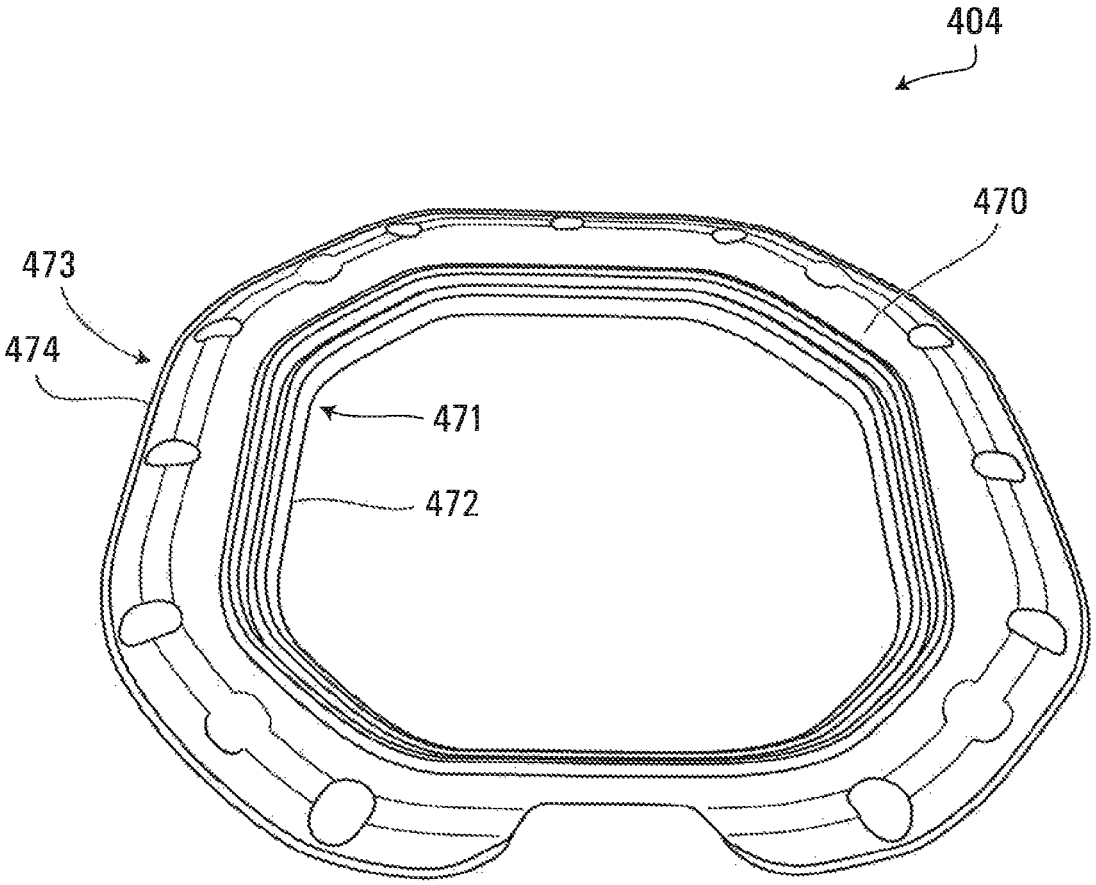
FIG. 1E illustrates a top perspective top view of the cover of the cassette of FIG. 1A.
Figure 1F:
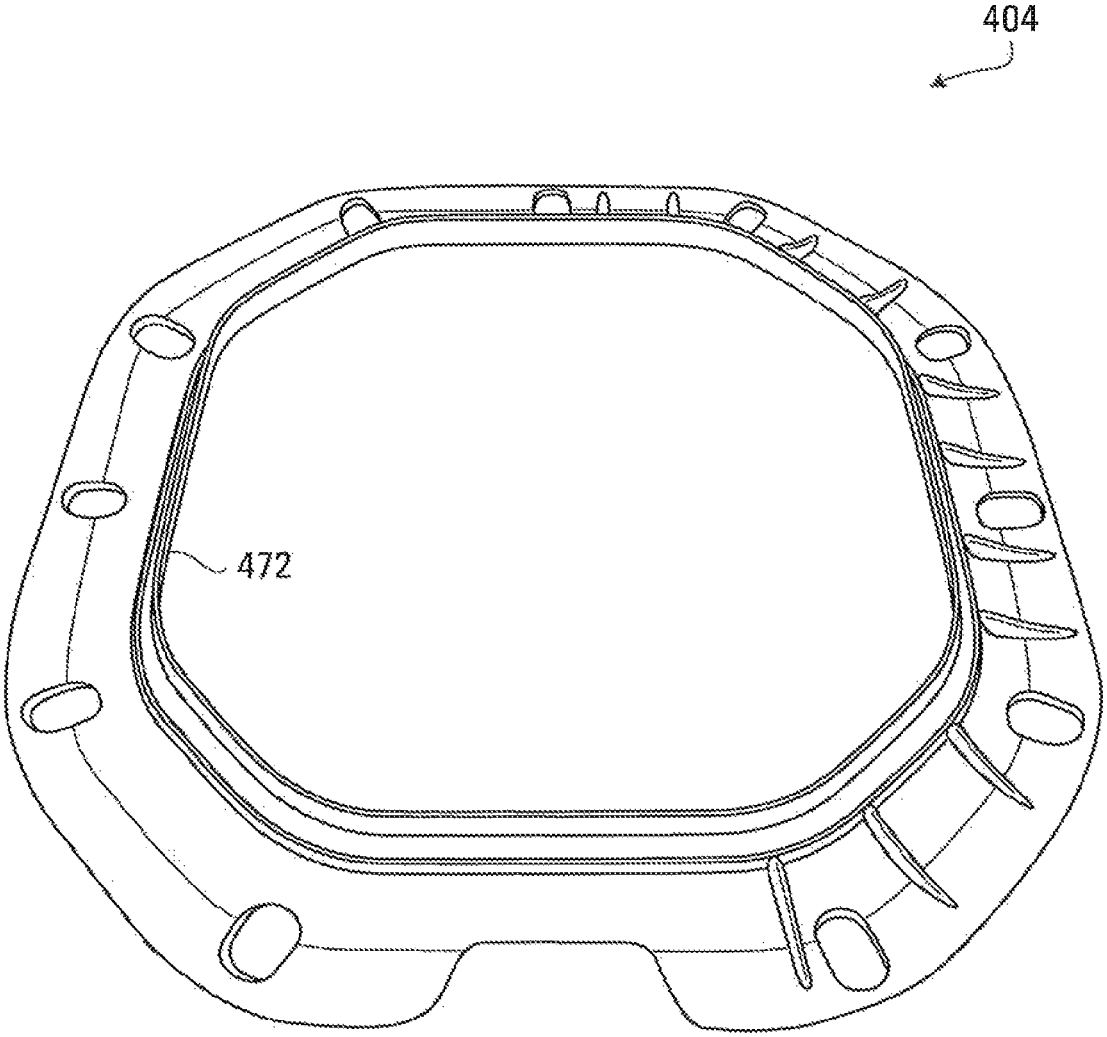
FIG. 1F illustrates a bottom perspective view of the cover of the cassette of FIG. 1A.
Figure 1G:
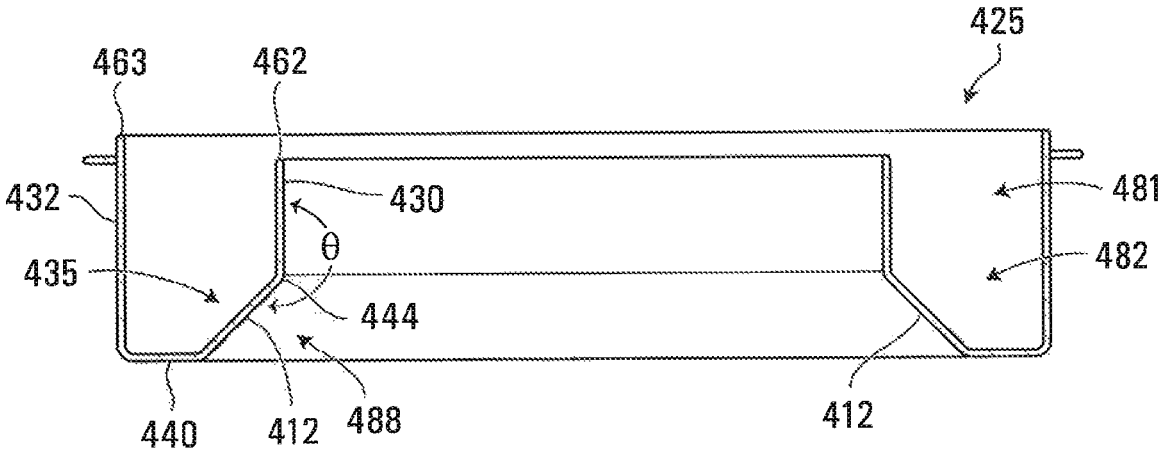
FIG. 1G is a cross-sectional view of the receptacle of FIG. 1D taken along the line 1G-1G of FIG. 1D.

As best shown in FIG. 1D and in FIG. 1G, the ring shaped receptacle 408 has a clearance 488 that is located outwardly of an imaginary projection of the inner wall 430 extending downwardly along the vertical axis. In a specific example of implementation, the clearance 488 is formed by an oblique wall 412 connecting with the lower end portion 438 of the inner wall 430 and extending outwardly and downwardly thereform. The oblique wall 412 defines a corner 444 with the lower end portion of the inner wall 430 having an angle θ substantially less than 270 degrees. The oblique wall 412 joins with the outer wall 432 through a bottom wall 440 that is substantially horizontal. The width of the bottom wall 440 is substantially less than the width of the oblique wall 412. In other embodiments, the width of the bottom wall 440 may be larger than the width of the oblique wall 412 or may be substantially equal. As illustrated, the oblique wall 412 forms a chamfer-like structure.

Although, the oblique wall 412 is provided on the full periphery of the receptacle 408 of the cassette 400, the oblique wall 412 may be partial (i.e., not on the full periphery of the opening 402 of the cassette 400) in other examples of implementation.

As shown in FIG. 1G, the oblique wall 412 reduces the width of the storage area 425 near the bottom 435 of the storage area 425. The storage area 425 defines a first portion 482 that is located laterally outward of the oblique wall 412 and that vertically registers with the oblique wall 412 having a reduced width relative a second portion 481 of the storage area 425 located above the first portion 482 and above the oblique wall 412. In other embodiments, the clearance 488 and the oblique wall 412 may be omitted and in such cases the bottom portion 435 comprises the bottom wall 440. In other words, the bottom portion would be formed by a horizontal flat wall only.

The cassette 400 includes a cover 404 that is located above the storage area 425. The cover 404 is designed to maintain the elongated tube (not illustrated) into the storage area 425 while allowing the tube to be dispensed therefrom in a controlled fashion. The cover 404 has a shape that corresponds to the shape of the receptacle 408, that is it is octagonal, however that is not essential. It is possible to use a cover that is of a different shape than the shape of the receptacle 408.

As shown in FIGS. 1E and 1F, the cover 404 has a top portion 470 that merges with a central funnel-like structure 471. The funnel-like structure 471 has downwardly descending wall portion 472. The cover 404 is releasably attached to the top of the inner wall 430 of the receptacle 408 by the downwardly descending wall portion 472 by a mechanical fastener or otherwise. In other embodiments, the cover 404 is non-removable from the receptacle 408.

The cover 404 also includes an outer peripheral wall 473 defined by an upturned lip 474. The lip 474 is laterally inwardly located from the upper peripheral edge 463 of the outer wall 432 of the receptacle 408 to define a gap 410 that extends along the entire periphery of the lip 474 to allow the accumulated tube in the storage area to be dispensed. In other words, the top peripheral edge of the outer peripheral wall 473 and the top peripheral edge 463 of the outer wall 432 define the gap 410, in this embodiment. In other embodiments, the gap 410 may be defined around the top peripheral edge 462 of the inner wall 430 and in such cases a cover may be releasably or non-releasably attached to the top peripheral edge 463 of the outer wall 432 of the receptacle 408. Yet, in other embodiments of the cassette 400, the cover 404 may be omitted, and is such cases the gap 410 is defined by the top peripheral edges 463 462 of the outer wall 432 and the inner wall 430. In even further embodiments, the funnel-like structure 471 of the cover 404 and/or the upturned lip 474 may be omitted. It is appreciated that the cover 404 may be made in numerous ways in various embodiments of the invention.

As illustrated, the shape of the cassette 400 is octagonal but that is a specific example of implementation. In this specific example, the cassette 400 has eight sides $\mathbf{431_1}$ $\mathbf{431_2}$ $\mathbf{431_3}$ $\mathbf{431_4}$ $\mathbf{433_1}$ $\mathbf{433_2}$ $\mathbf{433_3}$ $\mathbf{433_4}$. The four sides $\mathbf{433_1}$ $\mathbf{433_2}$ $\mathbf{433_3}$ $\mathbf{433_4}$ are the ones located at the corner and may be referred to as the minor sides, while the other sides $\mathbf{431_1}$ $\mathbf{431_2}$ $\mathbf{431_3}$ $\mathbf{431_4}$ may be referred to as the major sides. As illustrated, the minor sides $\mathbf{433_1}$ $\mathbf{433_2}$ $\mathbf{433_3}$ $\mathbf{433_4}$ are shorter than the major sides $\mathbf{431_1}$ $\mathbf{431_2}$ $\mathbf{431_3}$ $\mathbf{431_4}$. In other examples of implementation, the length of each of four sides $\mathbf{433_1}$, $\mathbf{433_2}$, $\mathbf{433_3}$, $\mathbf{433_4}$ may be longer in length in comparison to the length of each of the other four sides $\mathbf{431_1}$, $\mathbf{431_2}$, $\mathbf{431_3}$, $431_4$. Yet, in other cases, the length of all of the sides $431_1$, $431_2$, $431_3$, $431_4$, $433_1$, $433_2$, $433_3$, $433_4$ may be substantially equal in length.

In other examples of implementation, the cassette 400 may be generally square, rectangular, circular, hexagon shaped, oval shaped, any combination of the aforementioned shapes and/or any other suitable shape. Similarly, although the opening 402 is illustrated as a generally octagonal shape, the dimensions of the opening 402 may take on various sizes and shapes in examples of implementation. For example, the opening 402 may be generally square, rectangular, circular, hexagon shaped, octagon shaped, any combination of the aforementioned shapes and/or any other suitable shape. It is appreciated that the cover 404 may generally take the corresponding shape of the opening 402 on one side and the corresponding shape of the outer sidewall 432 on the other side.

Figure 2A:
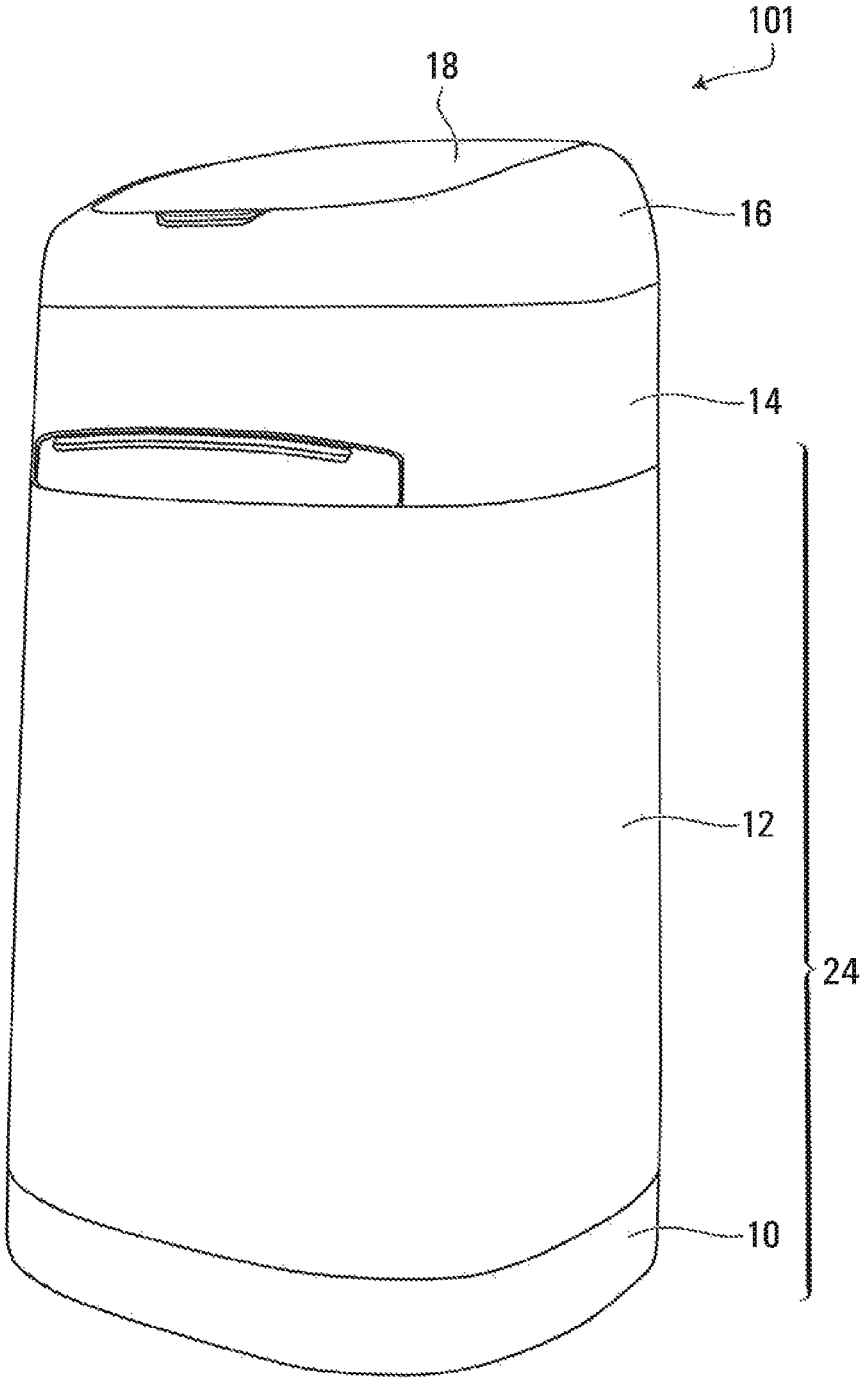
FIG. 2A is a perspective view of a waste storage container in which the cassette in accordance with an embodiment of the invention can be used.
Figure 2B:
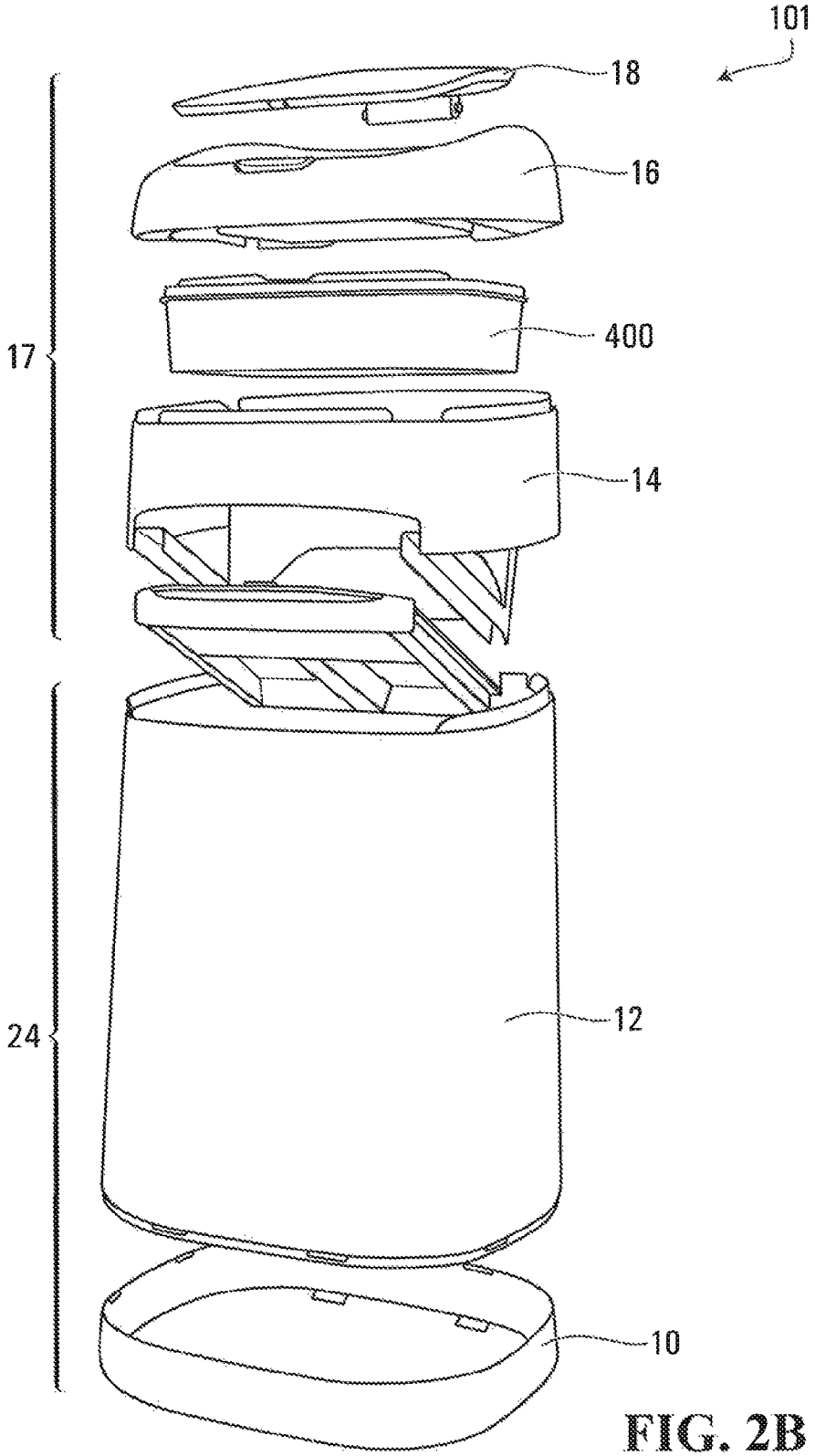
FIG. 2B is an exploded perspective view of the waste storage container of FIG. 2A.
Figure 3A:
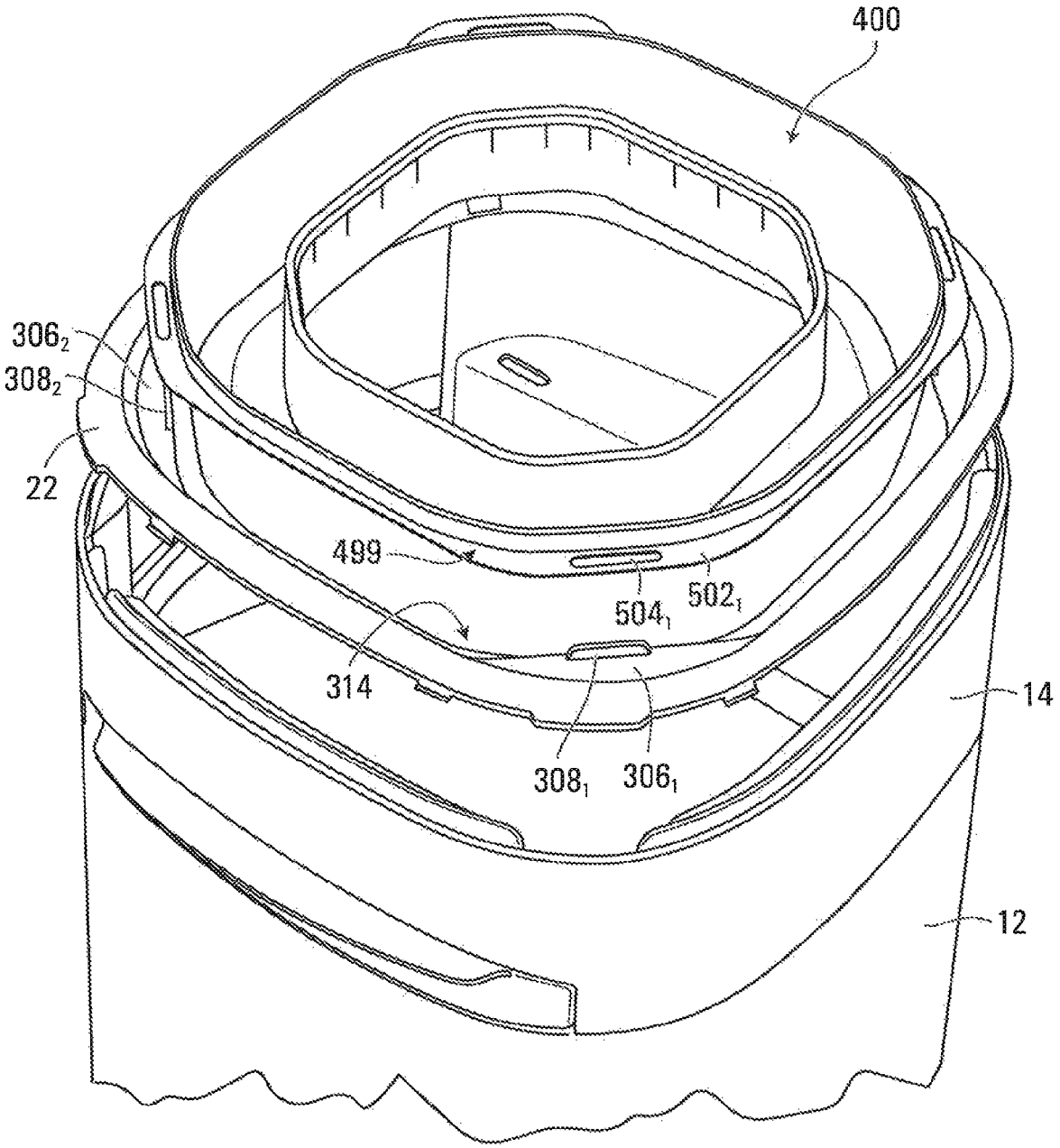
FIG. 3A is perspective, exploded view of a cassette holder and the receptacle of the cassette positioned to mate with the cassette holder, in accordance with an embodiment of the invention.
Figure 3B:
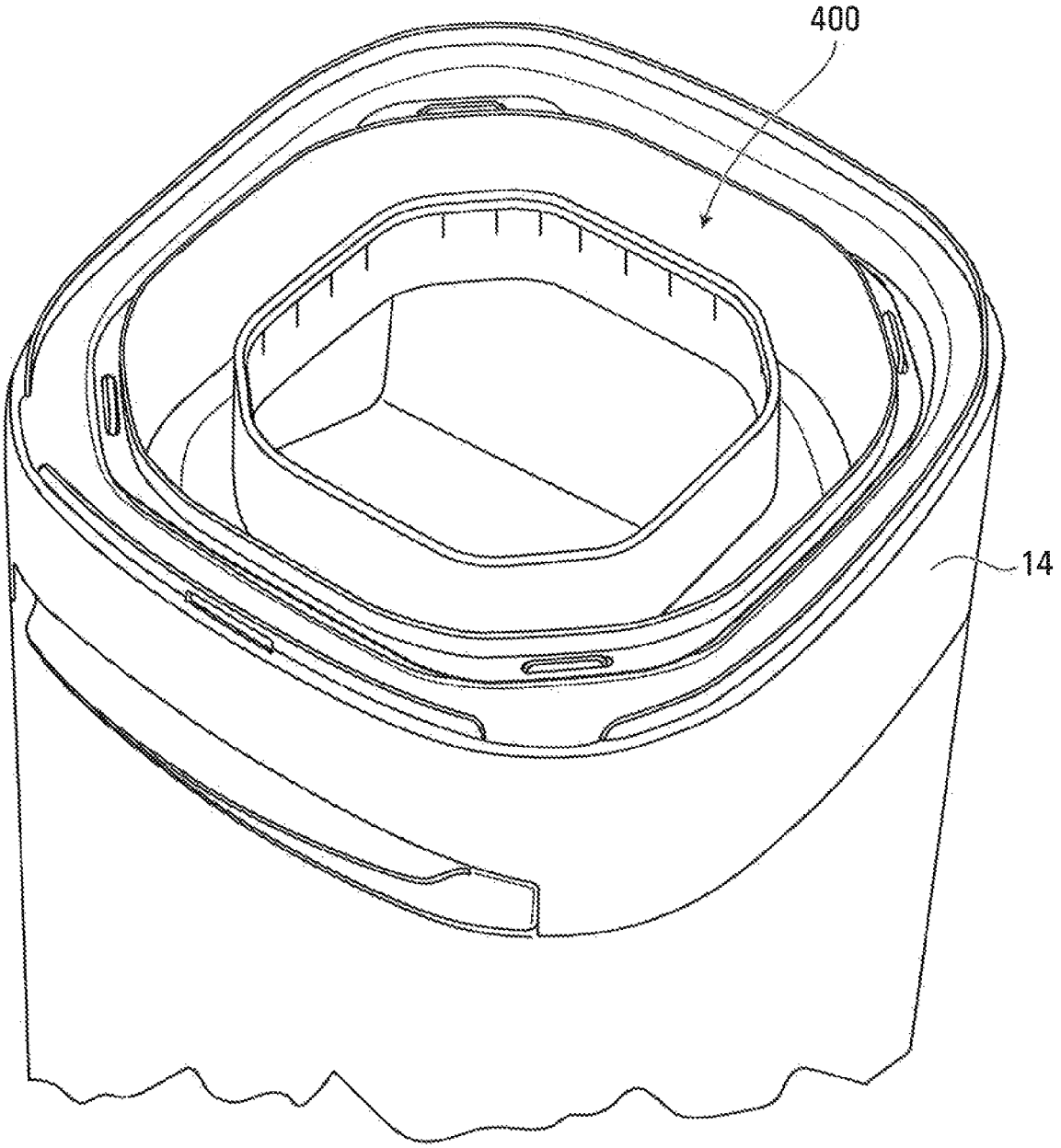
FIG. 3B is a perspective view of the cassette holder in which the receptacle of the cassette has been seated.
Figure 3C:
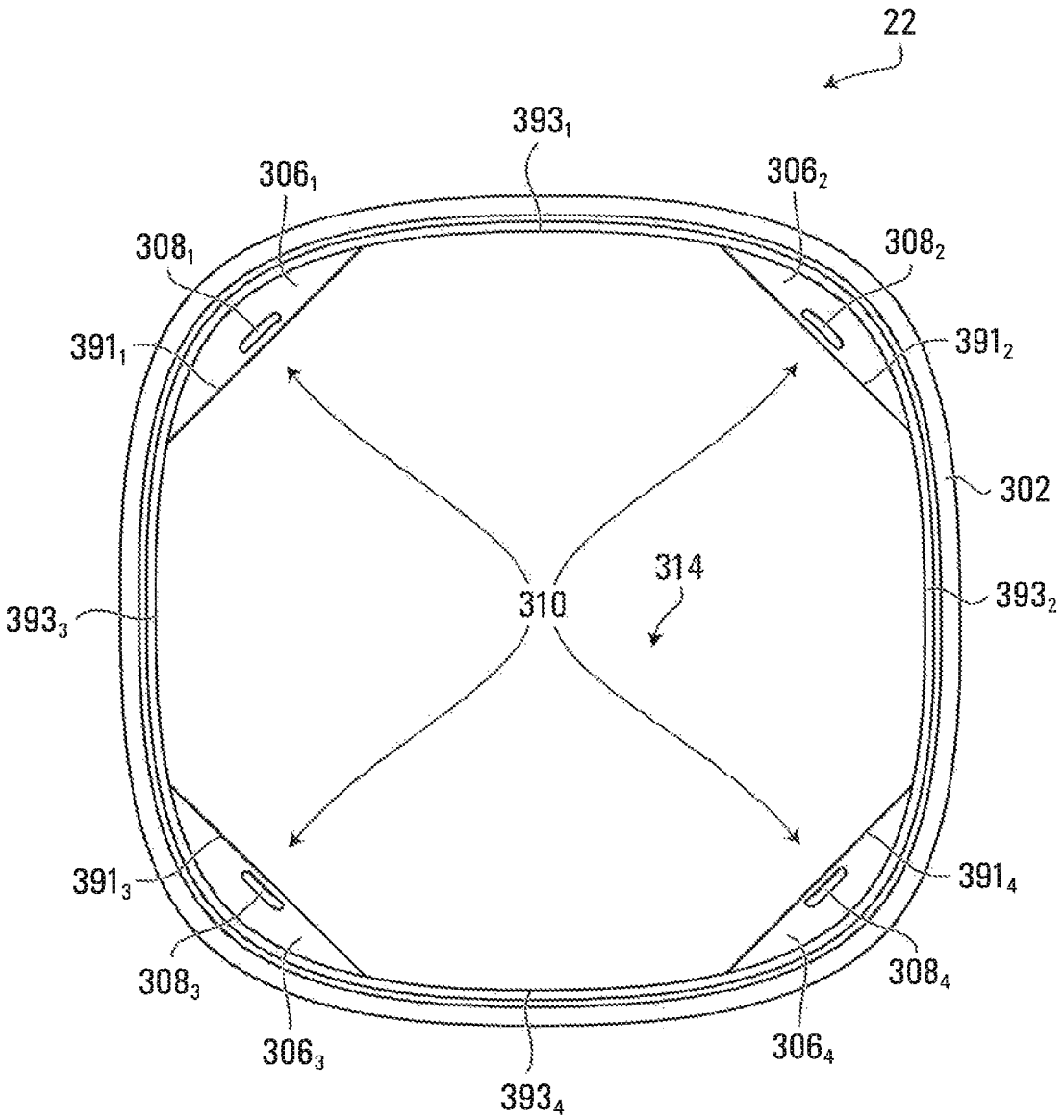
FIG. 3C is a top elevational view of rim portion of the cassette holder illustrating the periphery of the hollow space in which the receptacle of the cassette is received, the receptacle being omitted for clarity.
Figure 3D:
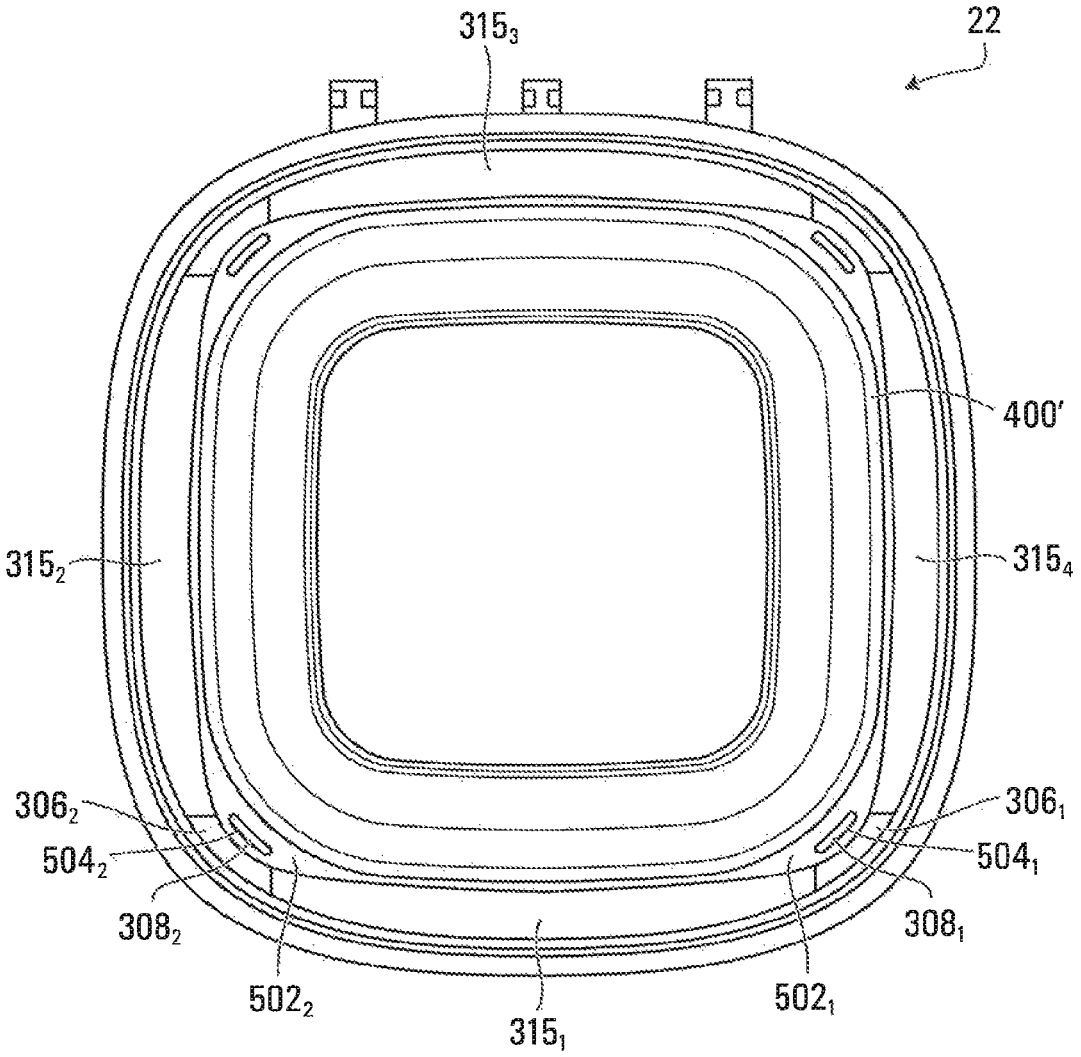
FIG. 3D a top elevational view of a rim portion according to a variant, also showing the receptacle of a cassette installed on the rim.

FIGS. 2A and 2B illustrate a waste container 101 and various elements of the waste storage container 101 in which the cassette 400 described earlier is used, in accordance with an embodiment of the invention. In this embodiment, the waste container 101 includes a base 10 and a main body 12 that engages with the base 10 to form a bin 24 for holding the waste enclosed in the tube. The bin 24 has outer walls defining an enclosure, which holds the waste-filled tube. Although in this embodiment, the bin 24 includes two parts (i.e., the base 10 and the main body 12), in other embodiments, the bin 24 may be one piece. In this embodiment, the waste storage container 101 also includes a closure assembly 17, which incorporates a cassette holder 14 and a top portion 16.

FIGS. 3A to 3D illustrate various elements of the closure assembly 17 in accordance with an embodiment of the invention. The closure assembly 17 engages with the upper end of the body 12 to form an upper wall of the bin 24 to hold the bin 24 closed. The closure assembly 17 defines a cassette holder 14 configured for receiving the cassette 400.

Figure 4A:
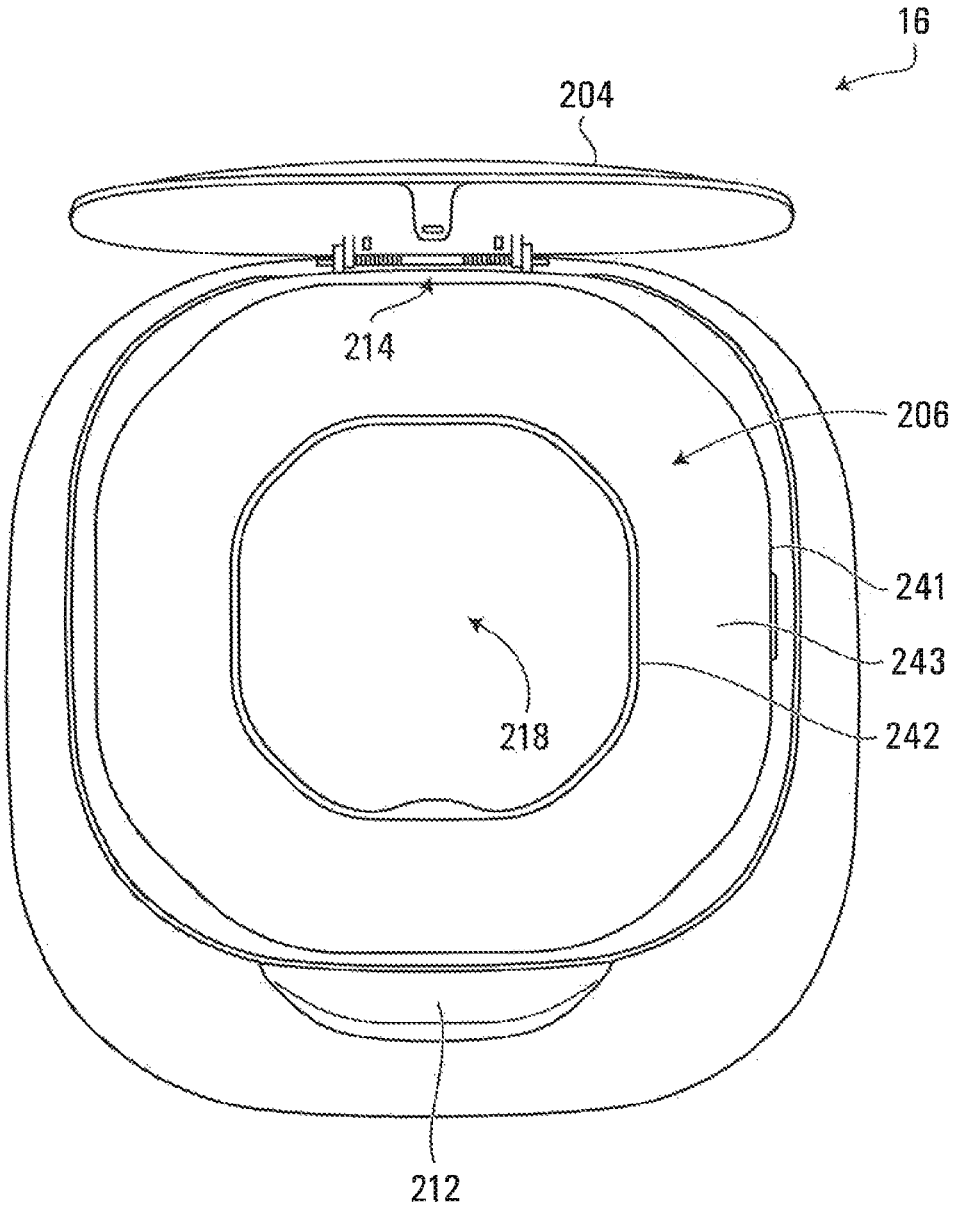
Figure 4B:
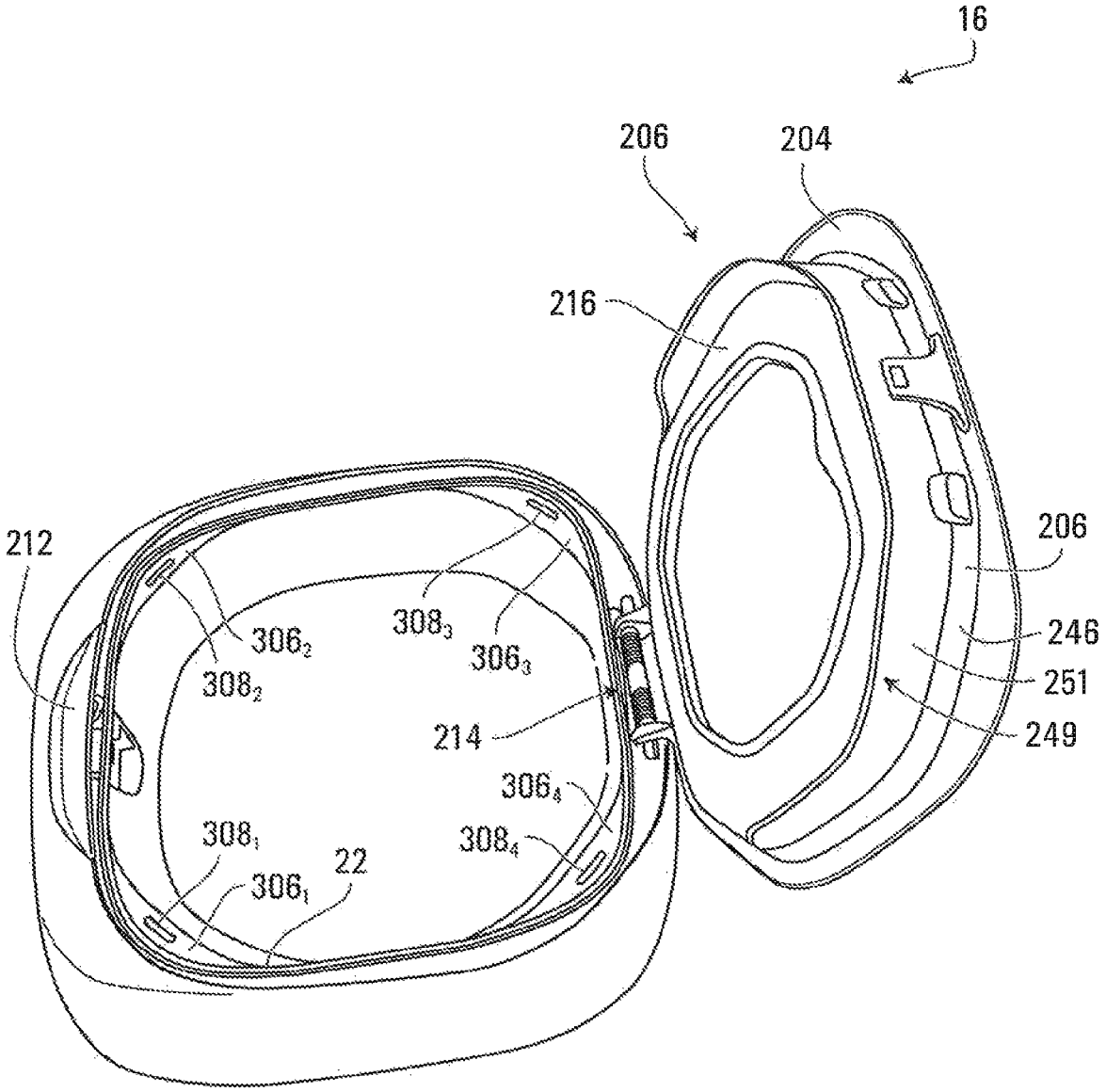
FIG. 4B is perspective view from the top of the closure assembly of FIG. 4A where a funnel component is shown in in an open position.

The closure assembly 17 includes a top portion 16. FIGS. 4A and 4B illustrate the top portion 16. The top portion 16 is removably mountable on the cassette holder 14, as shown in FIG. 2B. The top portion 16 of the closure assembly 17 defines a structure for guiding waste material to be disposed into the central opening 402 of the cassette 400. In a specific example of implementation, the structure for guiding the waste material is shaped as a funnel 206 having a wider opening at the top 241 that narrows toward a central opening 218 that registers with the central opening 402 of the cassette 400. In this example, the periphery of the bottom edge 242 of the funnel 206 defines the central opening 218.

The funnel 206 and the central opening 402 form essentially a chute through which the waste to be disposed of is pushed into the bin 24. Although not shown in the drawings, the chute may include a hinged, sliding or pivotable barrier to maintain the chute closed while no waste is being discarded. The barrier is configured to open when waste is to be inserted through chute.

The shape of the central opening 218 generally matches the shape of the central opening 402 of the cassette 400 or is slightly smaller such as to avoid the cassette 400 from being exposed to waste material being pushed into the chute. If the central opening 218 of the top portion 16 of the closure mechanism 17 was made larger than the central opening 402 of the cassette 400, the cassette 400 would project into the path of the disposed waste which would be undesirable. A most preferred arrangement is one where an aperture, defined by the openings 402 and 218, into which the waste is being placed by the user is essentially vertical without any significant inward projections on which waste can collect. Although the opening 218 is illustrated as a generally octagonal, the opening 218 may take on various sizes and shapes, in other examples of implementation. For example, the opening 218 may be generally square, rectangular, circular, hexagon shaped, octagon shaped, any combination of the aforementioned shapes and/or any other suitable shape.

As shown in FIGS. 4A and 4B, the funnel 206 is pivotally mounted to the top portion 16. In particular, FIG. 4A shows the case where the funnel 206 is in a closed position, overlying the cassette, while FIG. 4B shows the case where the funnel 206 is in an open position. In this fashion, the pivotal connection allows opening the closure assembly 17 for removing a spent cassette 400 and installation of a new cassette (refill). In this specific example, the funnel 206 is hingedly attached to the top portion 16 by the hinge member 214 such that the funnel 206 can be pivoted; however in other cases, other mechanisms may be provided for attaching the funnel 206 to the top portion 16.

The funnel 206, when closed down is configured to engage the cassette 400 such as to keep the cassette 400 firmly in place against motion forces resulting from a user pulling the tube and placing waste into it and also to provide some additional retention to the dispensing of the tube and avoid that too much tube length is being pulled (i.e., more than necessary). The lower side 216 of the funnel 206 has a structure designed to engage the cassette 400. The funnel 206 has a downward projection 249 that is configured to enter the gap 410 of the cassette 400 through which the tube is dispensed. In this fashion, the tube is constrained to slide against the projection 249 as it is being dispensed and requires some additional level of pulling three thus avoiding dispensing too much length. In a specific example of implementation, the downward projection 249 is a continuous wall portion 251 that penetrates the gap 410 over a significant portion of its length. Even more specifically, in this example, the continuous wall portion 251 has the same general configuration as the gap of the cassette such as to mate with it. The continuous wall portion 251 engages five out of eight sides of the gap 410, but more less extent of engagement is possible. As illustrated, in FIG. 4B, the wall 251 tapers upwardly at its ends. The depth of penetration of the downward projection 249 into the gap 410 is selected to account for a variable height of flexible tubing stack in the receptacle 408, as flexible tubing is being dispensed in use. In other words, the depth of penetration needs not be to much to prevent the funnel 206 of being closed when a new cassette, in which the flexible tubing stack is at its maximum.

The wall 251 is spaced inwardly from the periphery of the funnel 206 to provide a flange 246 that extends continuously around the periphery of the funnel 206. The flange 246 is designed to further engage the cassette 400 and to hold it in place once the funnel 206 is closed, as it will be discussed below.

When the funnel 206 is opened (as shown in FIG. 4B) or when the top portion 16 is removed completely from the cassette holder 14, the rim portion 22 of the cassette holder 14 is exposed. In that operational state of the closure assembly 17, a spent cassette can be removed and a new cassette can be loaded.

The rim portion 22 is configured to matingly engage the cassette 400 such that the cassette 400 is securely held in place. In a specific example of implementation, the cassette 400 is suspended from the rim portion; in other words, the cassette 400 is not supported by its bottom.

The rim portion 22 defines a hollow area 314 having an outer peripheral wall portion that is complementary to the shape of the cassette 400. The wall portion has a first pair of opposed cassette support elements and a second pair of opposed cassette support elements. The first and second pair of cassette support elements include inwardly extending projections $\mathbf{306_1}$ $\mathbf{306_2}$ $\mathbf{306_3}$ $\mathbf{306_4}$ that are used to hold the cassette.

In a specific example, the outer peripheral wall of the hollow area 314 of the cassette holder 14 is has a generally octagonal configuration, including the first pair of opposed cassette support elements $\mathbf{306_1}$ $\mathbf{306_2}$ and the second pair of opposed cassette support elements $\mathbf{306_3}$ $\mathbf{306_4}$.

The peripheral wall has generally straight sides $\mathbf{393_1}$ $\mathbf{393_2}$ $\mathbf{393_3}$ $\mathbf{393_4}$ that generally correspond in length to the major sides $\mathbf{431_1}$ $\mathbf{431_2}$ $\mathbf{431_3}$ $\mathbf{431_4}$ of the cassette and corners $\mathbf{391_1}$ $\mathbf{391_2}$ $\mathbf{391_3}$ $\mathbf{391_4}$ that correspond in length generally to the minor sides $\mathbf{433_1}$ $\mathbf{433_2}$ $\mathbf{433_3}$ $\mathbf{433_4}$ of the cassette 400. The generally straight sides are parallel in pairs, that is the sides $\mathbf{393_1}$ and $\mathbf{393_4}$ are substantially parallel with each other and the sides $\mathbf{393_2}$ and $\mathbf{393_3}$ are parallel with each other. The corners $\mathbf{391_1}$ $\mathbf{391_2}$ $\mathbf{391_3}$ $\mathbf{391_4}$ are also parallel in pairs, that is the corners $\mathbf{391_1}$ and $\mathbf{391_4}$ are parallel with each other and the corners $\mathbf{391_3}$ and $\mathbf{391_2}$ are parallel with each other.

This allows for the hollow space 314 to receive the cassette 400 without any major clearances between the cassette 400 and the rim 22. In other embodiments, such as the one shown in FIG. 3D, the cassette 400' (a variant of the cassette 400) is shaped such that larger clearances $\mathbf{315_1}$ $\mathbf{315_2}$ $\mathbf{315_3}$ $\mathbf{315_4}$ exist between the cassette 400 and the rim 22.

To prevent the cassette 400 from falling through the opening 314 in the rim 22 the cassette 400 includes a plurality of projecting elements $\mathbf{502_1}$ $\mathbf{502_2}$ $\mathbf{502_3}$ $\mathbf{502_4}$ that are configured to engage the projecting supports $\mathbf{306_1}$ $\mathbf{306_2}$ $\mathbf{306_3}$ $\mathbf{306_4}$ of the cassette holder 14. In other words, the plurality of projecting elements $\mathbf{502_1}$ $\mathbf{502_2}$ $\mathbf{502_3}$ $\mathbf{502_4}$ are provided in a spaced apart relationship, where the projecting elements $\mathbf{502_1}$ $\mathbf{502_2}$ $\mathbf{502_3}$ $\mathbf{502_4}$ extend from a periphery of the cassette 400 and are configured to support the cassette 400 in the waste storage container 101. In the specific example illustrated, the plurality of projecting elements $\mathbf{502_1}$ $\mathbf{502_2}$ $\mathbf{502_3}$ $\mathbf{502_4}$ lie in a common imaginary plane, which is generally horizontal. Furthermore, in this example, the projecting elements $\mathbf{502_1}$ $\mathbf{502_2}$ $\mathbf{502_3}$ $\mathbf{502_4}$ are generally equally spaced around the periphery of the cassette 400.

In accordance with a specific example of implementation, each of the projecting elements $\mathbf{502_1}$ $\mathbf{502_2}$ $\mathbf{502_3}$ $\mathbf{502_4}$ has an extent in a peripheral direction of the cassette 400 that is significantly larger than a thickness of the projecting element $\mathbf{502_1}$ $\mathbf{502_2}$ $\mathbf{502_3}$ $\mathbf{502_4}$ measured along the vertical axis.

Although in the embodiment illustrated, the plurality of projecting elements $\mathbf{502_1}$ $\mathbf{502_2}$ $\mathbf{502_3}$ $\mathbf{502_4}$ is shown as four, in other examples of implementation, the number of projecting elements $\mathbf{502_1}$ $\mathbf{502_2}$ $\mathbf{502_3}$ $\mathbf{502_4}$ may be more or less than four. Furthermore, in other embodiments, the plane from with plurality of projecting elements $\mathbf{502_1}$ $\mathbf{502_2}$ $\mathbf{502_3}$ $\mathbf{502_4}$ lie may not be a common imaginary plane and the direction of projection may vary from the horizontal plane (e.g., projects in an inclining or declining fashion from the horizontal plane). Moreover, in other embodiments, the projecting elements $\mathbf{502_1}$ $\mathbf{502_2}$ $\mathbf{502_3}$ $\mathbf{502_4}$ are not equally spaced around the periphery of the cassette 400, but are provided in a staggered orientation.

By way of a specific and non-limiting example, the projecting elements $\mathbf{502_1}$ $\mathbf{502_2}$ $\mathbf{502_3}$ $\mathbf{502_4}$ are defined by a continuous lip 499 with extends outwardly from the outer wall. The lip 499 has a variable width along the periphery of the receptacle and it is less wide at the major sides $\mathbf{431_1}$ $\mathbf{431_2}$ $\mathbf{431_3}$ $\mathbf{431_4}$ and wider at the minor sides $\mathbf{433_1}$ $\mathbf{433_2}$ $\mathbf{433_3}$ $\mathbf{433_4}$ such as to create an interference with the projecting supports $\mathbf{306_1}$ $\mathbf{306_2}$ $\mathbf{306_3}$ $\mathbf{306_4}$. As such, the lip 499 that projects outwardly from the cassette 400, extends along at least a portion of the periphery of the cassette 400 and has a variable projection width. It is appreciated that in this example, when the cassette 400 is loaded in the closure assembly 17, the lip portions at the minor sides $\mathbf{433_1}$ $\mathbf{433_2}$ $\mathbf{433_3}$ $\mathbf{433_4}$ will rest on top of the projecting supports $\mathbf{306_1}$ $\mathbf{306_2}$ $\mathbf{306_3}$ $\mathbf{306_4}$. In this fashion, the lip 499 suspends the cassette 400.

To further stabilize the cassette 400 in place, an interlock is provided between the projecting elements $\mathbf{502_1}$ $\mathbf{502_2}$ $\mathbf{502_3}$ $\mathbf{502_4}$ and the projecting supports $\mathbf{306_1}$ $\mathbf{306_2}$ $\mathbf{306_3}$ $\mathbf{306_4}$. In a specific example of implementation, the interlock includes a male/female interconnection. The male part $\mathbf{308_1}$ $\mathbf{308_2}$ $\mathbf{308_3}$ $\mathbf{308_4}$ of the interlock is formed on the projecting supports $\mathbf{306_1}$ $\mathbf{306_2}$ $\mathbf{306_3}$ $\mathbf{306_4}$ and the female part $\mathbf{504_1}$ $\mathbf{504_2}$ $\mathbf{504_3}$ $\mathbf{504_4}$ on the projecting elements $\mathbf{502_1}$ $\mathbf{502_2}$ $\mathbf{502_3}$ $\mathbf{502_4}$ such that when the cassette 400 is placed in the opening 314 of the cassette holder 14, the male parts $\mathbf{308_1}$ $\mathbf{308_2}$ $\mathbf{308_3}$ $\mathbf{308_4}$ will engage the female parts $\mathbf{504_1}$ $\mathbf{504_2}$ $\mathbf{504_3}$ $\mathbf{504_4}$. In other embodiments, the male part $\mathbf{308_1}$ $\mathbf{308_2}$ $\mathbf{308_3}$ $\mathbf{308_4}$ of the interlock is formed on the projecting elements $\mathbf{502_1}$ $\mathbf{502_2}$ $\mathbf{502_3}$ $\mathbf{502_4}$ and the female part $\mathbf{504_1}$ $\mathbf{504_2}$ $\mathbf{504_3}$ $\mathbf{504_4}$ on the projecting supports $\mathbf{306_1}$ $\mathbf{306_2}$ $\mathbf{306_3}$ $\mathbf{306_4}$. Although the in embodiment illustrated the interlock is provided between each of the projecting elements $\mathbf{502_1}$ $\mathbf{502_2}$ $\mathbf{502_3}$ $\mathbf{502_4}$ and the projecting supports $\mathbf{306_1}$ $\mathbf{306_2}$ $\mathbf{306_3}$ $\mathbf{306_4}$, in other embodiments, not all of the projecting elements $\mathbf{502_1}$ $\mathbf{502_2}$ $\mathbf{502_3}$ $\mathbf{502_4}$ and the projecting supports $\mathbf{306_1}$ $\mathbf{306_2}$ $\mathbf{306_3}$ $\mathbf{306_4}$ include the interlock. As such, at least one of the projecting elements $\mathbf{502_1}$ $\mathbf{502_2}$ $\mathbf{502_3}$ $\mathbf{502_4}$ includes a male or female interlocking component configured to engage a complementary male or female interlocking component in the waste storage container 101. In a specific example, the interlocking component of at least one of the projecting elements $\mathbf{502_1}$ $\mathbf{502_2}$ $\mathbf{502_3}$ $\mathbf{502_4}$ is a female interlocking component.

Figure 5A:
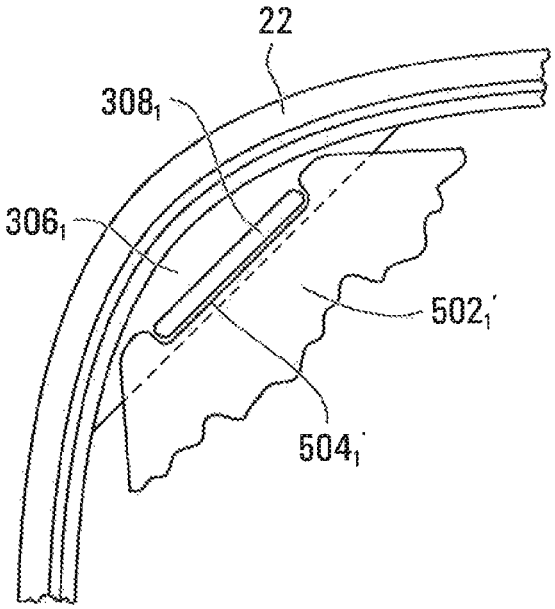
FIG. 5A illustrates an elevational fragmentary view of the cassette holder showing a variant of an interlock between the cassette and the cassette holder.
Figure 5B:
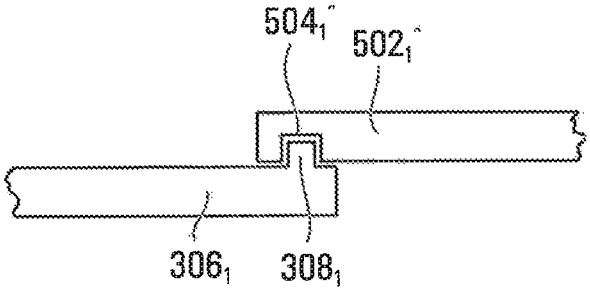
FIG. 5B illustrates another variant of an interlock between the cassette and the cassette holder.

As an example, the male parts $\mathbf{308_1}$ $\mathbf{308^2}$ $\mathbf{308_3}$ $\mathbf{308_4}$ can be made as tongues that extend generally parallel to the minor sides $\mathbf{433_1}$ $\mathbf{433_2}$ $\mathbf{433_3}$ $\mathbf{433_4}$ and they are shorter than the minor sides $\mathbf{433_1}$ $\mathbf{433_2}$ $\mathbf{433_3}$ $\mathbf{433_4}$ of the cassette 400. The female parts $\mathbf{504_1}$ $\mathbf{504_2}$ $\mathbf{504_3}$ $\mathbf{504_4}$ receive the tongues. For instance the female parts $\mathbf{504_1}$ $\mathbf{504_2}$ $\mathbf{504_3}$ $\mathbf{504_4}$ can be slots which are complementary to the tongues (as shown in FIGS. 3A to 3D). In other words, the interlocking component of one or more of the projecting elements $\mathbf{502_1}$ $\mathbf{502_2}$ $\mathbf{502_3}$ $\mathbf{502_4}$ is an elongated slot configured for receiving a male interlocking component in the waste storage container 101. Alternatively, the female parts $\mathbf{504_1'}$ $\mathbf{504_2'}$ $\mathbf{504_3'}$ $\mathbf{504_4'}$ can be cut outs or clearances that are larger than the tongues and simply clear the tongues (as shown in FIG. 5A). Another example is a blind recess $\mathbf{504_1''}$ $\mathbf{504_{2''}}$ $\mathbf{504_{3''}}$ $\mathbf{504_4''}$ instead of a through hole (as shown in FIG. 5B).

The projecting elements $\mathbf{502_1}$ $\mathbf{502_2}$ $\mathbf{502_3}$ $\mathbf{502_4}$ are located closer to the upper end of the cassette 400 than to its bottom such that the cassette 400 cannot be installed upside down. If the cassette 400 is attempted to be installed upside down, the lip 499 defined by the projecting elements $\mathbf{502_1}$ $\mathbf{502_2}$ $\mathbf{502_3}$ $\mathbf{502_4}$ will engage the projecting supports $\mathbf{306_1}$ $\mathbf{306_2}$ $\mathbf{306_3}$ $\mathbf{306_4}$ but the funnel 206 will not be able to be closed which will make it clear to the user that the cassette 400 is improperly installed.

In this embodiment, when the funnel 206 is closed (e.g., as shown in FIG. 4A) the flange 246 of the funnel 206 rests on top of the male projecting parts $\mathbf{308_1}$ $\mathbf{308_2}$ $\mathbf{308_3}$ $\mathbf{308_4}$ preventing the projecting elements $502_1$ $502_2$ $502_3$ $502_4$ to be lifted off the projecting supports $306_1$ $306_2$ $306_3$ $306_4$. In the example shown, the flange 246 will engage the tops of the tongues of the male projecting parts $308_1$ $308_2$ $308_3$ $308_4$. Another option is to provide in the flange 246 recesses (not illustrated) that register with the tongues of the male projecting parts $308_1$ $308_2$ $308_3$ $308_4$ such that they are received in the recesses when the funnel 206 is closed. In this fashion, the flange 246 bears directly on the lip 499 defined by the projecting elements $502_1$ $502_2$ $502_3$ $502_4$ of the cassette 400 to bring even more stability.

The male/female interlock engagement can obviously vary and may include rounded pins and complementary holes and any other combinations of shapes. The arrangement may also be such as to require the cassette 400 to be placed in a specific angular orientation, in other words, locate a specific projecting element of the cassette in a specific projecting support on the rim.

In this embodiment, the closure assembly 17 may also include a spring-biased lid 18, which is hingedly attached to the top portion 16 by the hinge member 214 such that the lid 18 can be opened to provide the user access to the funnel, for example to dispose of waste materials. An actuator 212 is shown in the form of a button which keeps the lid 18 closed (e.g., FIG. 2A). When a user actuates the actuator (e.g., pushes the button) this causes the lid 18 to move from a closed position (e.g., FIG. 2A) to an open position (e.g., FIG. 4A).

Figure 6:
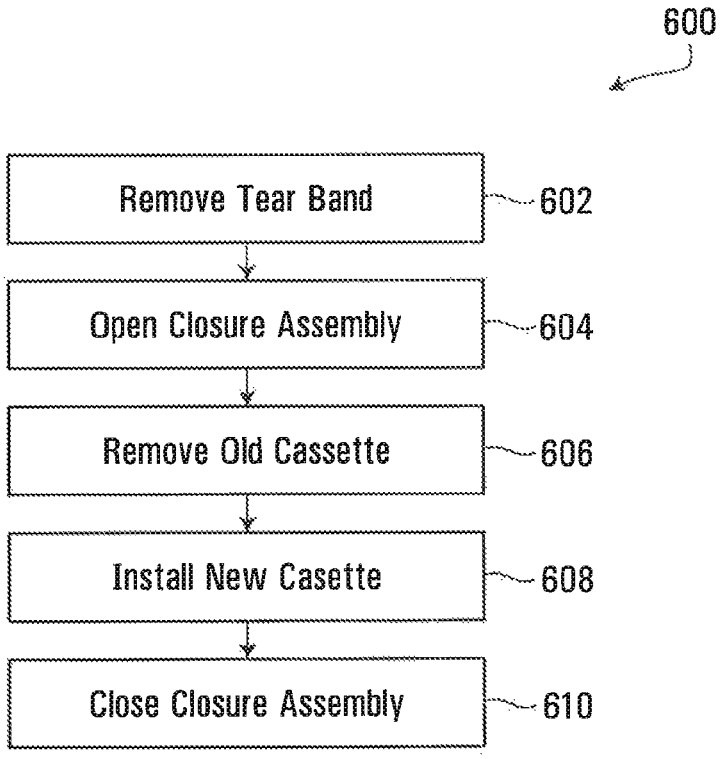
FIG. 6 is a flowchart for a method of replacing a spent cassette with a new one, in accordance with an embodiment of the invention.

FIG. 6 is a flowchart for a method 600 of replacing a cassette in accordance with an embodiment of the invention. When the cassette is empty the user takes a new cassette (refill) and removes the tear band 418, if equipped to open the gap 410 (step 602). The closure assembly 17 is opened by lifting the funnel 206 to expose the old cassette 400 (step 604). The old cassette 400 is removed (step 606) and a new one put in place (step 608). The lip 499 defined by the projecting elements $502_1$ $502_2$ $502_3$ $502_4$ of the cassette 400 rests on the projecting supports $306_1$ $306_2$ $306_3$ $306_4$ and the male/female interlocks engage. The tube is prepared for use (e.g., a knot may be tied in the end portion to form a bag and is inserted into the opening 218 of the funnel 206 and into the enclosure of the bin 24) and the funnel 206 is closed (step 610).

A method for installing a cassette 400 where a cassette is not currently present in the cassette holder 14 would follow a similar process to that of method 600; however, the step of removing an old cassette would be omitted in such case.

Figure 7A:
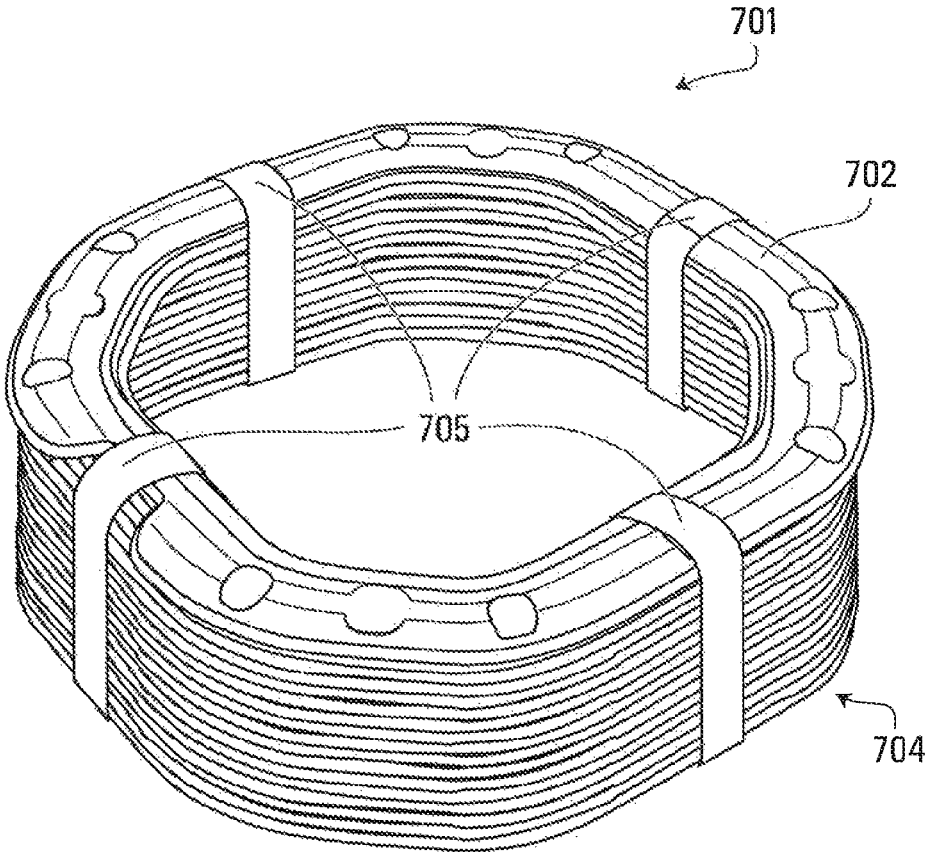
FIG. 7A illustrates a perspective view of a variant of a refill for a cassette in which the receptacle of the spent cassette is being re-used.
Figure 7B:
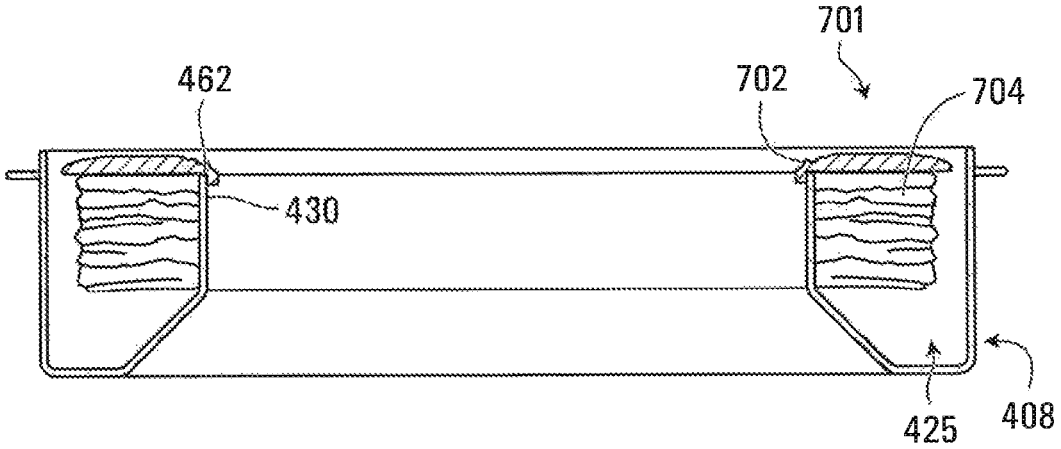
FIG. 7B is a vertical cross-sectional view of a receptacle of a spent cassette in which the refill of FIG. 7A is installed.

Instead of using a new cassette that is identical to the spent cassette, a refill can be considered that uses one or more components of the spent cassette. Such a refill is shown in FIGS. 7A and 7B. The refill 701 has no receptacle 408, in other words the original receptacle 408 is being re-used. The refill 701 has a replacement cover 702 to which a length of elongated tubing 704 in an accumulated or pleated condition is attached to the cover 702. The pleats of the tube 704 can be retained to one another to prevent the tube 704 from unraveling before it is being installed in the old receptacle 408. This can be accomplished by a plurality of tear-away bands 705 that hold the tube against the cover 702. The cover 702 is put on the old receptacle 408 (after the old cover is removed) and the tear-away bands 705 are removed to release the tube 704, that can now be pulled out of the gap and used for receiving waste.

Figure 7C:
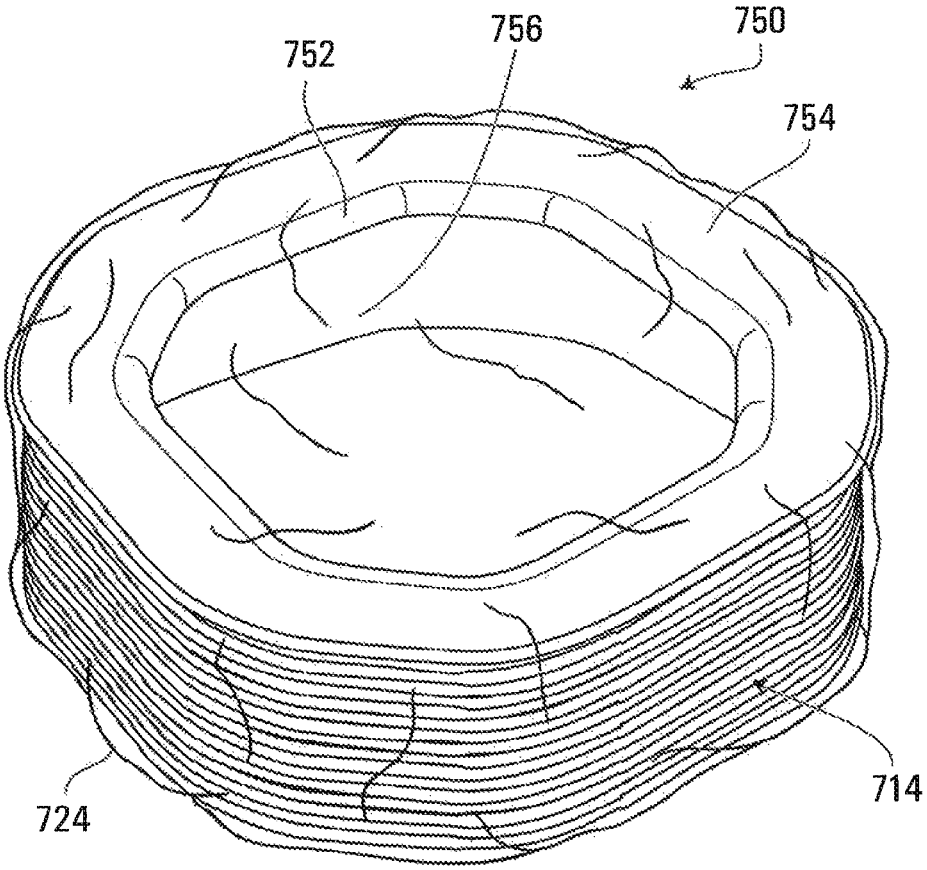
FIG. 7C is a perspective view of another possible refill variant for a cassette in accordance with an embodiment of the invention.
Figure 7D:
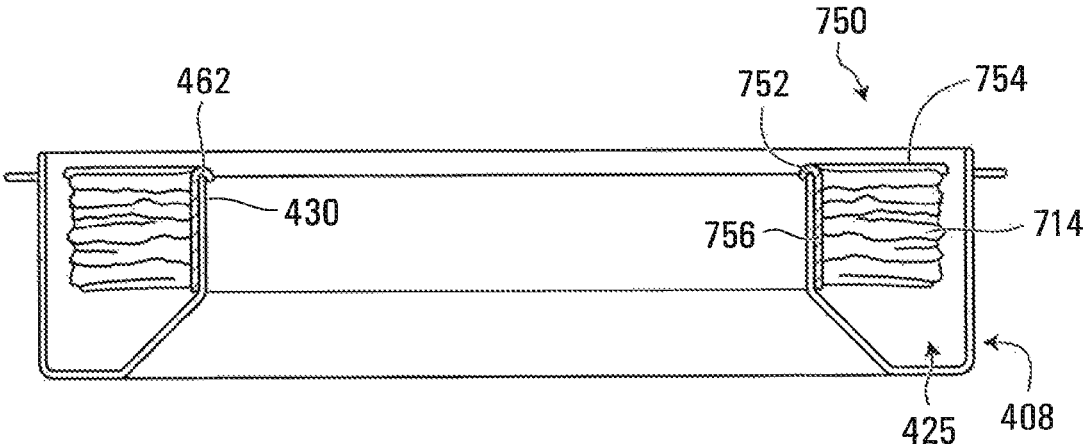
FIG. 7D is a vertical cross-sectional view of a receptacle of a spent cassette in which the refill of FIG. 7C is installed.

Another example, is that of refill 750 shown in FIGS. 7C and 7D. The refill 750 is provided without the receptacle 408, in other words the original receptacle 408 is also being re-used. The refill 750 has a tube support portion 756 having a cover part 754 with a depending vertical wall 756 that defines a tubular structure dimensioned to slip over the inner wall 430 of the original receptacle. A connecting element 752 engages the top peripheral edge 462 of the inner wall 430 of the receptacle 408 and to hold the refill 750 in place when installed in the receptacle 408. A layer of shrink-wrap 724 or other suitable material holds the tube 714 against the vertical wall 756. The shrink-wrap prevents the tube 714 from unraveling before it is being installed in the old receptacle 408. Once the refill 750 is put into the old receptacle 408 and the shrink-wrap 724 is removed, the cassette so re-loaded is ready for use. The shrink-wrap can be removed by providing a suitable tear-band (not illustrated).

It is appreciated that the cassette 400 and the waste container 101 may be used to dispose of various waste materials including but not limited to disposable baby diapers, cat litter, animal feces, garbage, other soiled materials, or any other suitable waste materials/objects.

In some embodiments, any feature of any embodiment described herein may be used in combination with any feature of any other embodiment described herein.

Certain additional elements that may be needed for operation of some embodiments have not been described or illustrated as they are assumed to be within the purview of those of ordinary skill in the art. Moreover, certain embodiments may be free of, may lack and/or may function without any element that is not specifically disclosed herein.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A cassette for packing waste material into an elongated tube of flexible material, the cassette, comprising:

(a) a ring-shaped receptacle defining a central opening, the central opening extending along a generally vertical axis, the ring-shaped receptacle defining a storage area receiving a length of elongated tube of flexible material in a folded condition outward of the central opening;

(b) a peripheral portion including a plurality of outwardly projecting elements in a spaced apart relationship, the projecting elements being configured to suspend the cassette in a waste storage container.

2. A cassette as defined in claim 1, wherein the plurality of projecting elements lie in a generally common imaginary plane.

3. A cassette as defined in claim 2, wherein the imaginary plane is generally horizontal.

4. A cassette as defined in claim 3, wherein each projecting element has an outward extent measured along a direction that is normal to the vertical axis, that is larger than a thickness of the projecting element measured along the vertical axis.

5. A cassette as defined in claim 1, wherein the projecting elements are equally spaced around the periphery of the cassette.

6. A cassette as defined in claim 2, including a cover in a top portion of the storage area.

7. A cassette as defined in claim 1, wherein the ring-shaped receptacle is annular.

8. A cassette as defined in claim 1, wherein the peripheral portion includes a plurality of straight sides joined to each other at an angle.

9. A cassette as defined in claim 8, wherein the plurality of straight sides include a first side and a second side, the first and second sides being generally parallel.

10. A cassette as defined in claim 1, wherein the peripheral portion includes a plurality of sides of unequal length.

11. A cassette for packing waste material into an elongated tube of flexible material, the cassette comprising:

(a) a ring-shaped receptacle defining a central opening, the central opening extending along a generally vertical axis, the ring-shaped receptacle defining a storage area receiving the elongated tube of flexible material in a collapsed condition outward of the central opening;

(b) a lip projecting outwardly from the ring-shaped receptacle and extending along at least a portion of the periphery of the cassette, the lip having a variable projection width, (c) the lip defining a plurality of sides of the cassette, including a first pair of generally parallel sides and a second pair of generally parallel sides, which extend generally transversally to the first pair of parallel sides.

12. A cassette as defined in claim 11, including a cover in a top portion of the storage area.

13. A cassette as defined in claim 11, wherein the first and second pairs of sides are major sides, the cassette including a first pair of generally parallel minor sides and a second pair of generally parallel minor sides, the minor sides being shorter than the major sides.

14. A cassette as defined in claim 13, wherein the projection width of the lip is larger in the vicinity of the minor sides than the projection width in the vicinity of the major sides.

15. A cassette as defined in claim 11, wherein the lip constitutes means to suspend the cassette in a waste storage container.

16. A cassette as defined in claim 15, comprising a bottom, the lip is configured to support the cassette in the waste storage container while the cassette hangs by the lip and is unsupported by the bottom.

17. A cassette as define in claim 11, wherein the ring-shaped receptacle is annular.

18. A cassette for packing waste material into an elongated tube of flexible material, for use in a waste storage container, the storage container including a cassette holder, the cassette holder having a rim defining a hollow area for removably receiving the cassette, the hollow area having an outer peripheral wall portion having a generally octagonal configuration, the wall portion including a first pair of opposed cassette support elements and a second pair of opposed cassette support elements, the cassette having a body configured to matingly fit the hollow area and having means to engage the rim to suspend the cassette from the rim.

19. A cassette as defined in claim 18, including a plurality spaced apart projecting elements configured for engaging the first and second pairs of opposed cassette support elements.

20. A cassette as defined in claim 19, wherein the cassette has a generally octagonal configuration including minor sides and major sides, the minor sides being shorter than the major sides, the projecting elements being associated with minor sides of the cassette.

21. A cassette as defined in claim 20, wherein the plurality of spaced apart projecting elements lie in a common imaginary plane.

22. A waste storage container including:

(b) a holder for a cassette for packing waste material into an elongated tube of flexible material, the cassette, comprising:

(a) a ring-shaped receptacle defining a central opening, the central opening extending along a generally vertical axis, the ring-shaped receptacle defining a storage area receiving a length of elongated tube of flexible material in a folded condition outward of the central opening;

(c) a plurality of projecting elements in a spaced apart relationship, the projecting elements extending from a periphery of the cassette and being configured to support the cassette in a waste storage container, (d) the waste storage container including a cassette holder including a plurality of projecting supports configured to engage the projecting elements to retain the cassette in the cassette holder.

23. A waste storage container as defined in claim 22, wherein the plurality of projecting supports include a first pair of generally opposed projecting supports and a second pair of generally opposed projecting supports.

24. A waste storage container as defined in claim 23, wherein the cassette holder defines a generally octagonal recessed area to matingly receive the cassette.

* * * * *